US010486956B2

(12) United States Patent
Ware et al.

(10) Patent No.: US 10,486,956 B2
(45) Date of Patent: Nov. 26, 2019

(54) APPARATUS AND METHODS FOR FILLING AND DISPENSING LIQUIDS

(71) Applicant: Entegris, Inc., Billerica, MA (US)

(72) Inventors: Donald D. Ware, South St. Paul, MN (US); Amy Koland, Eden Prairie, MN (US); Richard Lee Wilson, Edina, MN (US)

(73) Assignee: ENTEGRIS, INC., Billerica, MA (US)

( * ) Notice: Subject to any disclaimer, the term of this patent is extended or adjusted under 35 U.S.C. 154(b) by 0 days.

(21) Appl. No.: 16/153,149

(22) Filed: Oct. 5, 2018

(65) Prior Publication Data

US 2019/0039875 A1 Feb. 7, 2019

Related U.S. Application Data

(63) Continuation of application No. 14/904,275, filed as application No. PCT/US2014/046421 on Jul. 11, 2014, now abandoned.

(Continued)

(51) Int. Cl.
*B67D 1/12* (2006.01)
*B67D 7/02* (2010.01)

(Continued)

(52) U.S. Cl.
CPC ..... *B67D 1/1252* (2013.01); *B67D 1/0802* (2013.01); *B67D 7/0261* (2013.01);

(Continued)

(58) Field of Classification Search
CPC .. B67D 1/1252; B67D 1/0802; B67D 7/0261; B67D 7/0288; B67D 7/72; B67D 2001/0828

(Continued)

(56) References Cited

U.S. PATENT DOCUMENTS 2,150,673 A * 3/1939 De Steffan ..... B67D 1/08 222/146.1
2,742,048 A * 4/1956 Kromer ..... B67D 1/04 137/12.5

(Continued)

FOREIGN PATENT DOCUMENTS

CN 101124128 2/2008
EP 1 136 435 A1 9/2001

(Continued)

*Primary Examiner* — Benjamin R Shaw
(74) *Attorney, Agent, or Firm* — Entegris, Inc.

(57) ABSTRACT

A shippable liquid storage and dispensing apparatus includes a collapsible liner arranged within a container, with a dispense head coupled to the container, suitable for handling oxygen- and moisture-sensitive materials. The dispense head includes a pressurization gas passage, a pressurization gas valve, a liquid passage, a liquid valve, a liner gas passage, and a liner gas valve, wherein each valve may have an associated quick connect fitting. The dispense head remains attached to the container during inert gas purging, liner filling, container shipment, and liquid dispensing. Pressurized inert gas may be maintained in the liner overlying liquid-containing material during shipment of the coupled dispense head and container. The container may have an extended chime to provide a protective zone that contains the entirety of the dispense head.

16 Claims, 24 Drawing Sheets

Related U.S. Application Data

(60) Provisional application No. 61/845,315, filed on Jul. 11, 2013.

(51) Int. Cl.
*B67D 1/08* (2006.01)
*B67D 7/72* (2010.01)

(52) U.S. Cl.
CPC ..... *B67D 7/0288* (2013.01); *B67D 7/72* (2013.01); *B67D 2001/0828* (2013.01)

(58) Field of Classification Search
USPC ..... 222/105
See application file for complete search history.

(56) References Cited

U.S. PATENT DOCUMENTS 4,548,335 A * 10/1985 Remes ..... B65D 81/3811 220/560.1
4,956,975 A * 9/1990 Gustafson ..... F17C 5/02 137/202
4,956,978 A 9/1990 Gustafson
5,251,787 A * 10/1993 Simson ..... B67D 1/0462 222/105
5,348,048 A * 9/1994 Schirado ..... B67D 1/1256 137/588
5,356,045 A * 10/1994 Parks ..... B67D 1/0802 220/214
6,015,068 A * 1/2000 Osgar ..... B01J 4/00 222/105
6,079,597 A * 6/2000 Rauworth ..... B65D 1/20 222/400.7
6,237,809 B1 * 5/2001 Kawai ..... B67D 7/0261 222/105
6,505,469 B1 * 1/2003 Drube ..... F17C 7/04 62/48.1
8,114,479 B2 * 2/2012 Spohn ..... C23C 16/4409 118/715
2005/0045662 A1 * 3/2005 Raats ..... B65D 77/067 222/400.7
2005/0224523 A1 * 10/2005 O'Dougherty ..... B67D 7/0261 222/399
2008/0061258 A1 * 3/2008 Grimwade ..... B67D 1/0462 251/90
2009/0020176 A1 * 1/2009 Hasegawa ..... B67D 7/0261 137/614.05
2009/0045622 A1 * 2/2009 Phillips ..... F16L 35/00 285/330
2009/0184133 A1 * 7/2009 Hasegawa ..... B67D 7/0261 222/95
2009/0188919 A1 7/2009 Takanohashi
2009/0212071 A1 8/2009 Tom et al.
2010/0025430 A1 * 2/2010 Cisewski ..... B67D 7/0261 222/95
2010/0112815 A1 * 5/2010 O'Dougherty ..... B67D 7/0261 438/689
2010/0133292 A1 * 6/2010 Ware ..... B67D 7/0261 222/1
2012/0187153 A1 * 7/2012 Burge ..... B67D 1/0462 222/386.5
2012/0291627 A1 * 11/2012 Tom ..... B67D 7/0261 95/8
2013/0136835 A1 5/2013 Fiedler
2014/0103066 A1 * 4/2014 Geert Norbert ..... B67D 1/0418 222/95
2014/0117043 A1 * 5/2014 Ware ..... B65D 85/84 222/95
2014/0131380 A1 * 5/2014 Pethe ..... B67D 7/0255 222/95
2014/0328982 A1 * 11/2014 Standaert ..... B67D 1/0437 426/116
2017/0174498 A1 * 6/2017 Hasunuma ..... B65D 51/1672
2017/0240405 A1 * 8/2017 Gibson ..... B67D 1/0406
2017/0260037 A1 * 9/2017 Dalton ..... B67D 1/1252

FOREIGN PATENT DOCUMENTS

EP 1 136 436 9/2001
JP 59-9386 1/1984
JP H11-223331 A 8/1999
TW I356141 1/2012
WO 96/01226 1/1996
WO 2011/085012 7/2011

* cited by examiner

FIG. 15
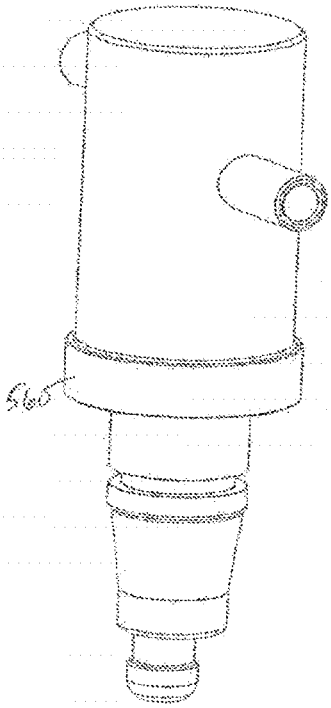
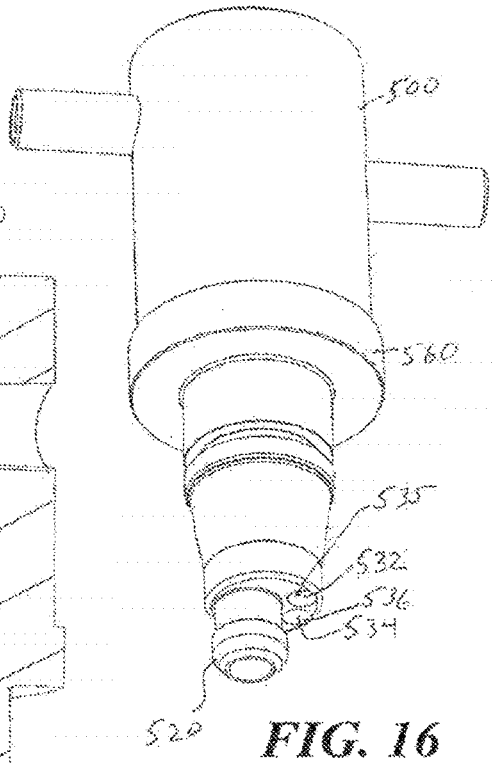
FIG. 16
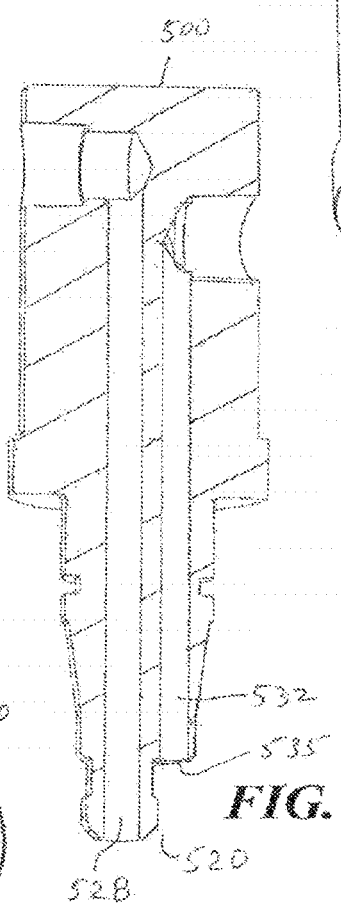
FIG. 17
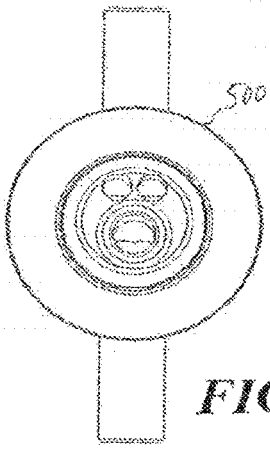
FIG. 18

APPARATUS AND METHODS FOR FILLING AND DISPENSING LIQUIDS

RELATED APPLICATION

This application is a Continuation of U.S. patent application Ser. No. 14/904,275, filed Jan. 11, 2016, which is a National Phase entry of PCT Application No. PCT/US2014/046421, filed Jul. 11, 2014, which claims the benefit of U.S. Provisional Patent Application No. 61/845,315, filed Jul. 11, 2013, the disclosures of which are hereby incorporated by reference herein in their entireties.

TECHNICAL FIELD

The present invention relates to liquid handling and dispensing systems and methods, such as may be utilized to fill containers and permit dispensation of contents of such containers. In a specific aspect, the invention relates to filling and dispensing of environmentally sensitive (e.g., oxygen-sensitive and/or moisture-sensitive) liquids from liner-based containers while minimizing or reducing exposure between such liquids and the ambient environment. Associated aspects relate to fabrication, use, and deployment of such systems.

BACKGROUND

In many industrial applications, chemical reagents and compositions are required to be supplied in a high purity state, and specialized packaging has been developed to ensure that the supplied material is maintained in a pure and suitable form, throughout the package fill, storage, transport, and ultimate dispensing operations.

In the fields of microelectronic device and display panel manufacturing, the need for Suitable packaging is particularly compelling for a wide variety of liquids, since any contaminants in the packaged material, and/or ingress of environmental contaminants to the contained material in the package, can adversely affect the microelectronic device and display panel products that are manufactured with such liquids, rendering the resulting products deficient or even useless for their intended use.

As a result of these considerations, many types of high-purity packaging have been developed for liquids used in microelectronic device and display panel manufacturing, such as photoresists, etchants, chemical vapor deposition reagents, solvents, wafer and tool cleaning formulations, chemical mechanical polishing compositions, color filtering chemistries, overcoats, liquid crystal materials, etc.

One type of high-purity packaging that has come into such usage includes a rigid, substantially rigid, or semi-rigid container (also known as an overpack) containing a liquid in a flexible liner or bag that is secured in position in the overpack by retaining structure such as a lid or cover. Such packaging is commonly referred to as "bag-in-can" (BIC), "bag-in-bottle" (BIB) and "bag-in-drum" (BID) packaging. Packaging of such general type is commercially available (e.g., under the trademark NOWPak®) from Advanced Technology Materials, Inc. (Danbury, Conn., USA).

Preferably, a liner comprises a flexible material, and the surrounding (e.g., overpack) container comprises a wall material that is substantially more rigid than said flexible material. Rigid or semi-rigid containers of the packaging may be formed (for example) of high-density polyethylene, or other polymer or metal, and the liner may be provided as a pre-cleaned, sterile collapsible bag of a polymeric film material, such as polytetrafluoroethylene (PTFE), tow-density polyethylene, medium-density polyethylene, PTFE-based laminates, polyamide, polyester, polyurethane, or the like, selected to be inert to the material (e.g., liquid) to be contained in the liner. Multilayer laminates comprising any of the foregoing materials may be used. Examples of liners comprising multi-layer laminates are disclosed in U.S. Patent Application Publication No. 2009/0212071 A1, which is hereby incorporated by reference herein. Exemplary materials of construction of a liner further include: metalized films, foils, polymers/copolymers, laminates, extrusions, co-extrusions, and blown and cast films. Liner-based packaging of such general type is commercially available under the trademark NOWPAK from Advanced Technology Materials, Inc.

In use of liner-based packaging to dispense liquids and liquid-based compositions, a liquid or liquid-containing composition is commonly dispensed from the liner by connecting a dispensing assembly including a dip tube or short probe to a port of the liner, with the dip tube being immersed in the contained liquid. Fluid (e.g., gas) pressure is applied to the exterior surface of the liner (i.e., in the space between the liner and a surrounding container) to progressively collapse the liner and thereby force liquid through the dispensing assembly for discharge to associated flow circuitry to flow to an end-use tool or site. Such operation may be called liner-based pressure dispensing. Use of a liner containing a liquid to be dispensed prevents direct contact with pressurized fluids, such as gases, arranged to exert pressure against the liner.

Headspace (extra air or gas at the top of a liner) and microbubbles present challenges for liquid dispensing from liner-based packages, including contexts such as flat panel display and integrated circuit manufacturing. Headspace gas may derive from the filling operation, in which the package is less than completely filled with the liquid. Less than complete filling of the package has been employed in certain contexts in order to provide a headspace as an expansion volume to accommodate changes in the ambient environment of the package, such as temperature changes that cause the liquid to expand during transport of the package to a location where the package will be placed in dispensing operation.

A liner-based pressure dispense container is typically filled at a chemical fill facility. The container is typically formed of stainless steel and has a unitary chime extending around the upper circumference of the container. After such a container is filled, such container is typically sealed with a membrane, cap, and/or other closure, and shipped to a point of use, typically a processing facility. At the point of use, an end user couples the container with a dispense head preconnected to process equipment and arranged to permit addition of pressurizing gas to an interstitial space between the liner and the container, and to permit a liquid-containing composition to be extracted from the liner. The dispense head extends upwardly from the top and the uppermost portion of the fitting of the container and above the chimes of the container.

Certain liquids (e.g., for display panel and microelectronic device manufacturing) are highly sensitive to oxygen and/or moisture, and may be subject to spoilage or reduced shelf life due to exposure to oxygen or moisture and the processes that utilize such materials are compromised. Conventional use of liner-based pressure dispense containers subject to ingress of air (e.g., including water vapor) at multiple intervals—i.e., during filling or sealing, during shipment, and/or at the time of coupling to a dispense head.

It would be desirable to minimize such exposure with procedures and apparatus. Improvements are always sought in reducing complexity of componentry, reduction of manufacturing costs, and increasing the robustness, durability, and cleanliness of containers and dispense heads.

In other instances, liquids used in processing can be very odorous, often very unpleasant to smell, in some cases harmful. In such instances it would be desirable to eliminate or minimize the exposure of such liquids with the ambient environment so that fumes and spillages do not happen or are minimized.

SUMMARY

A process and apparatus for use in semiconductor processing minimizes air and moisture contamination associated with dispensing of processing.

A shippable container with an internal liner has a dispense head installed at a chemical facility with steps taken to eliminate or minimize any containment surfaces from contact with ambient air. The process liquid is put into a bag purged with a clean dry gas in a rigid container through the dispense head at the chemical supply facility. The container with the process liquids and with the dispense head is then shipped to a process facility for use of the fluid in processing. The container and dispense head have features to minimize risk of exposure of the fluids to personnel and the environment as well as minimizing risk of damage to the dispense head. The process system or other plumbing system is connected to the dispense heads with dispense heads. Protocols during the filing of the container and dispensing of the fluid minimize any entry of ambient air into the dispense head as well as any direct access of the process fluid to personnel, thus minimizing any opportunity for contamination of the fluid and minimizing any risk to personnel.

In embodiments of the invention, a shippable liquid storage and dispensing apparatus has a substantially rigid container containing a collapsible liner configured as a bag, wherein the liner comprises an interior, and an interstitial space is arranged between the liner and the container; a dispense head coupled to a mouth portion of the container, the dispense head comprising a liquid passage in fluid communication with the interior of the liner, a liner gas passage in fluid communication with the interior of the liner, and a pressurization gas passage in fluid communication with the interstitial space; a tubing dispense head fitting and a liquid valve associated with the liquid passage; a liner dispense head and gas valve associated with the liner gas passage; and a pressurization gas valve and a dispense head associated with the pressurization gas passage. In certain embodiments, liner gas valve comprises or has associated therewith a liner gas valve quick connect fitting, with the liner gas valve arranged between the dispense head and the liner gas valve quick connect fitting.

In embodiments of the invention, a container is in combination with a dispense head, container comprises a stainless steel container portion with a diameter and with upper and lower chimes welded to the container portion. The container portion having a cylindrical shaped outer wall and dome shaped end walls. The chimes may be welded to the dome shaped end walls or to the cylindrical shaped outer wall. The upper chime having a lip that extends above the dispense head and defining a protective zone for dispense head. In embodiments the upper chime has a height extending axially that is more than 20% of the entire axial height of the container. In embodiments the upper chime has a height extending axially that is more than 25% of the entire axial height of the container. In embodiments the upper chime has a height extending axially that is more than 30% of the entire axial height of the container. In embodiments the upper chime has a height extending axially that is between 25% and 40% of the entire axial height of the container. In embodiments the lower chime has a radially recessed portion sized to fit within the upper chime such that a non radially recessed portion sits on a lip of the upper chime. In embodiments a panel removable covers the protective space defined by the upper chime. The panel may have a latch or retention mechanism to removal secure the panel to the upper chime.

In embodiments of the invention, a dispense head comprises a minimal number of components and is advantageously directly coupled to the mouth of a container and engages a fitting on a liner configured as a bag positioned in the container, the dispense head has a lower body portion, a probe portion extending centrally through the lower body portion, an upper body portion positioned over the lower body portion and secured thereto, a nut extending around the lower portion and captured between the upper body portion and the lower body portion. The probe portion having a fluid flow passageway extending axially for dispensing liquid in the drum and a gas flow passageway extending axially for managing gas above the liquid in the bag. The probe having a male fitting for receiving a down tube and an outlets positioned above the down tube for the management of the gas above the liquid in the bag. The upper body portion and lower body portion have a fluid passageway extending axially and positioned to communicate with an interstitial space between the bag and a container wall of the container. The nut rotatable with respect to the lower body portion, the upper body portion and the probe portion. The nut may have internal threads for engaging external threads on the threaded mouth of the container.

In embodiments of the invention, a shippable dispense head arranged for mating with a substantially rigid container containing a collapsible liner with an interstitial space between the liner and the container, and with a fitment of the liner registered with a mouth portion of the container, the dispense head comprising: a dispense head body defining (i) a liquid passage and a liner gas passage arranged to permit fluid communication with an interior of the liner, and (ii) a pressurization gas passage in fluid communication with the interstitial space, wherein an insertion (e.g., probe) portion of the dispense head includes at least one sealing element is insertable into the fitment to sealingly engage a portion of the fitment, with a terminus of the liner gas passage arranged below the at least one sealing element to permit fluid communication with an upper portion of the liner; and a dip tube extending past the fitment into the interior of the liner, wherein the liquid passage extends to or through the dip tube to permit extraction of fluid material from a lower portion of the liner; a liner gas valve in fluid communication with the liner gas passage; a liquid valve in fluid communication with the liquid passage; and a pressurization gas valve in fluid communication with the pressurization gas passage.

In embodiments of the invention, a fluid handling method utilizing a substantially rigid container containing a collapsible liner and a dispense head coupled to a mouth of the container and comprising a liquid passage in fluid communication with an interior of the a liner gas passage in fluid communication with the interior of the liner, a pressurization gas passage in fluid communication with an interstitial space between the liner and the container, a liquid valve in fluid communication with the liquid passage, a liner gas valve in fluid communication with the liner gas passage, and a pressurization gas valve in fluid communication with the pressurization gas passage, the method comprising: supplying inert gas through the dispense head to an interior of the liner; following the inert gas supplying step, removing inert gas from the interior of the liner through the dispense head to at least partially deflate the liner; following the inert gas removing step, at least partially re-inflating the liner with inert gas; following the liner re-inflating step, supplying a liquid-containing material through the dispense head to at least partially fill the interior of the liner with the liquid-containing material while allowing at least a portion of the inert gas within the liner to escape through the dispense head; and following the liquid-containing material supplying step, closing the liquid supply valve.

In embodiments of the invention, a fluid handling method utilizing a substantially rigid container containing a collapsible liner and a dispense head coupled to a mouth of the container and comprising a liquid passage in fluid communication with an interior of the liner, a liner gas passage in fluid communication with the interior of the liner, a pressurization gas passage in fluid communication with an interstitial space between the liner and the container, a liquid valve in fluid communication with the liquid passage, a liner gas valve in fluid communication with the liner gas passage, and a pressurization gas valve in fluid communication with the pressurization gas passage, the method comprising: supplying inert gas through the dispense head to an interior of the liner; following the inert gas supplying step, removing inert gas from the interior of the liner through the dispense head to at least partially deflate the liner; following the inert gas removing step, at least partially re-inflating the liner with inert gas; following the liner re-inflating step, supplying a liquid-containing material through the dispense head to at least partially fill the interior of the liner with the liquid-containing material while allowing at least a portion of the inert gas within the liner to escape through the dispense head; and following the liquid-containing material supplying step, closing the liquid supply valve.

In embodiments of the invention, a dispense head features a nut that attaches directly to threading on the threaded mouth of the container. The threaded mouth unitary with a container portion and chime of the container. The dispense head further has central probe portion that has two fluid passageways, an upper body portion, and a lower body portion that each have at least one fluid passage way, and a nut. The upper and lower body portion are removably fastened together with screws and sandwich a portion of the nut therebetween allowing freedom for the nut to rotate. The upper and lower body portions further secure the probe portion therebetween. The central probe portion has a fitting for a diptube and having a passageway for fluid in the headspace of the liner.

In another aspect, any one or more features of the foregoing aspects and/or any other aspects and features disclosed herein may be combined for additional advantage.

A feature and advantage of embodiments of the invention is that user exposure to potentially harmful chemicals is minimized in that at no time is there an open access to chemicals in a container at the processing facility, the containers are always.

A feature and advantage of embodiments of the invention is that injury to personnel is minimized in that handling personnel, both at the chemical supply facility and at the process facility are not directly exposed to the contained process fluids or such exposure is minimized.

A feature and advantage of embodiments of the invention is that dispense tubes and dispense heads are not inserted or installed into containers with processing fluids therein. In embodiments of the invention, the installation of the dispense tubes and dispense head is accomplished before the processing chemicals are placed in the container. This minimizes potential exposure to personnel, minimizes contamination of the process fluid, and minimizes the risk of spillage of exposure of the environment to the process fluids.

A feature and advantage of embodiments of the invention is that the dispense head is protected from impact damage by being fully contained in a shroud defining a protected space. The shroud may be provided by extended container chimes extending above the dispense head. Such protection is ideally permanently affixed to the container portion of the container and then is present at the chemical supply facility where it is filled, during transport, while at any storage facility, and at the processing facility or point of use.

A feature and advantage of embodiments of the invention is that the chimes have access openings and the dispense head has dispense heads oriented horizontally in alignment with the chime openings. This provides the advantage of also providing protection to the dispense head and all the dispense heads thereof when it is installed in the process facility and during dispensing of the process fluids.

A feature and advantage of embodiments of the invention is a dispense head that has a minimal number of components.

A feature and advantage of embodiments of the invention is that contamination of the facilities or the environment is minimized in that handling personnel, both at the chemical supply facility and at the process facility are not directly exposed to the contained process fluids.

Other aspects, features and embodiments of the invention will be more fully apparent from the ensuing disclosure and appended claims.

BRIEF DESCRIPTION OF THE DRAWINGS

FIG. 15 is a perspective view of a probe portion of a dispense head according to embodiments of the inventions herein.

FIG. 16 is another upwardly looking perspective view of the probe portion of FIG. 15.

FIG. 17 is a cross section view of the probe portion of FIGS. 15 and 16.

FIG. 18 is a plan view looking upwardly of the probe portion of FIGS. 15-17.

DETAILED DESCRIPTION

Figure 1A:
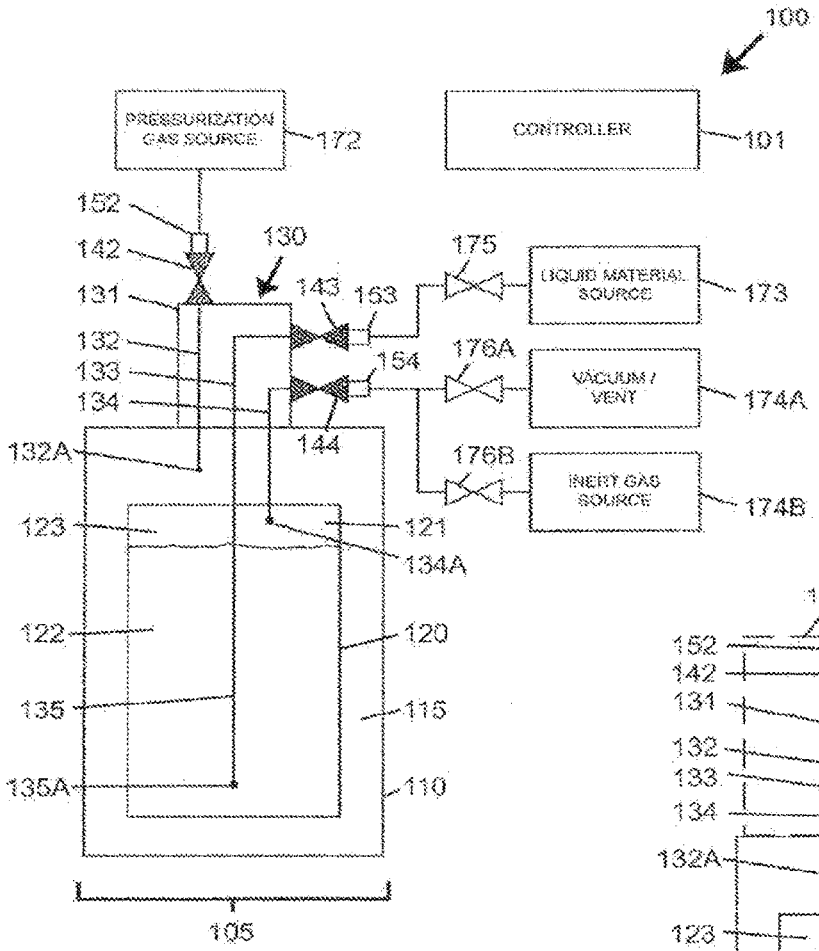
FIG. 1A is a simplified schematic view of a fluid handling system arranged for filling a shippable liquid storage and dispensing apparatus including a liner-based pressure dispense package according to one embodiment of the present invention.

The present invention relates in certain aspects to improved fluid handling apparatuses and methods for filling and dispensing oxygen- and moisture-sensitive materials. In a specific aspect, the invention relates to a liner-based liquid containment systems and methods for storing, shipping, dispensing high purity chemical reagents and compositions, e.g., photoresists, etchants, chemical vapor deposition reagents, solvents, wafer cleaning formulations, tool cleaning formulations chemical mechanical polishing compositions, color filtering chemistries, overcoats, and liquid crystal materials.

In the use of liner-based packages for storage and dispensing of fluid materials, wherein the liner is mounted in an outer vessel (e.g., preferably substantially rigid, but optionally semi-rigid), the dispensing operation may involve the flow of a pressure-dispense gas into the vessel, exteriorly of the liner, so that the pressure exerted by the gas forces the liner to progressively be compacted so that the fluid material in the liner in turn is forced to flow out of the liner. A liner-based package can be coupled with a suitable pressurized gas source, such as a pump, compressor, a compressed gas tank, etc. The dispensed fluid material may be flowed to or through piping, manifolds, dispense heads, valves, etc. to a locus of use such as a fluid-utilizing process tool.

A liner-based package includes a dispensing port that is in communication with the liner for dispensing of material therefrom. The dispensing port in turn is coupled with a suitable dispensing assembly. The dispensing assembly can take any of a variety of forms, e.g., an assembly including a probe or dispense head with a dip tube that contacts material in the liner and through which material is dispensed from the vessel. The package can be a large-scale package, wherein the liner has a capacity in a range of from 1 to 2000 or more liters of material. In embodiments the liner has a capacity of 14 liters or about 14 liters, in embodiments 40 liters or about 40 liters, in embodiments 200 liters or about 2040 liters. In embodiments the package is less than or about 20 liters, in embodiments less than or about 50 liters, in embodiments less than or about 100 liters, in embodiments less than or about 200 liters.

The liner can be formed in any suitable manner, through use of one or more sheets of film or other material that may be sealed (e.g., welded) along edges thereof In one embodiment, multiple flat sheets are superimposed (stacked) and sealed along edges thereof to form a liner. One or more sheets may include a port or cap structure along an upper portion of a face thereof In another one embodiment, tubular blow molding i s used with formation of an integral fill opening at an upper end of the vessel, which may be joined to a port or cap structure. The liner thus may have an opening for coupling of the liner to a suitable dispense head for fill or dispense operations involving respective introduction or discharge of fluid. Such opening may be reinforced with structure and termed a "fitment." A fitment typically includes a laterally extending flange portion to which thin film is joined, and a tubular portion extending in a direction substantially perpendicular to the flange portion. A liner fitment may mate with or otherwise contact a container port, container cap or closure, or other suitable structure. A cap or closure may also be arranged to couple with a diptube or downtube for introduction or dispensation of fluid.

In certain embodiment, a liner may be formed from tubular stock material. By the use of a tubular stock, e.g., a blown tubular polymeric film material, heat seals and welded seams along the sides of the liner are avoided. The absence of side welded seams may be advantageous to better withstand forces and pressures that tend to stress the liner, relative to liners formed of flat panels that are superimposed and heat-sealed at their perimeter. In certain embodiments, a liner may be formed of tubular stock material that is cut lengthwise and subsequently welded to form one or more welded seams.

A liner preferably is a single-use, thin membrane liner, arranged to be removed after each use (e.g., when the container is depleted of the liquid contained therein) and replaced with a new, pre-cleaned liner to enable the reuse of the outer container. Such a liner is preferably free of components such as plasticizers, antioxidants, UV stabilizers, fillers, etc. that may be or become a source of contaminants, e.g., by leaching into the liquid contained in the liner, or by decomposing to yield degradation products that have greater diffusivity in the liner and that migrate to the surface and solubilize or otherwise become contaminants of the liquid in the liner.

Preferably, a substantially pure film is utilized for the liner, such as virgin (additive-free) polyethylene film, virgin polytetrafluoroethylene (PTFE) film, or other suitable virgin polymeric material such as polyvinylalcohol, polypropylene, polyurethane, polyvinylidene chloride, polyvinylchloride, polyacetal, polystyrene, polyacrylonitrile, polybutylene, etc. More generally, the liner may be formed of laminates, co-extrusions, overmold extrusion, composites, copolymers and material blends, with or without metallization and foil. A liner material can be any suitable thickness, e.g., in a range from about 1 mils (0.001 inch) to about 120 mils (0.120 inch). In one embodiment, the liner has a thickness of 20 mils (0.020 inch).

In certain embodiments, a liner may be advantageously formed of a film material of appropriate thickness to be flexible and collapsible in character. In one embodiment, the liner is compressible such that its interior volume may be reduced to about 10% or less of the rated fill volume, i.e., the volume of liquid able to be contained in the liner when same is fully filled in the housing 14. In various embodiments, the interior volume of a liner may be compressible to about 0.25% or less of rated fill volume, e.g., less than 10 milliliters in a 4000 milliliter package, or about 0.05% or less (10 mL or less remaining in a 19 L package), or 0.005% or less (10 mL or less remaining in a 200 L package). Preferred liner materials are sufficiently pliable to allow for folding or compressing of the liner during shipment as a replacement unit. The liner preferably is of a composition and character that is resistant to particle and microbubble formation when liquid is contained in the liner, that is sufficient flexible to allow the liquid to expand and contract due to temperature and pressure changes and that is effective to maintain purity for the specific end use application in which the liquid is to be employed, e.g., in semiconductor manufacturing or other high purity-critical liquid supply application.

In certain embodiments, a rigid or substantially rigid collapsible liner may be used. As used herein, the terms "rigid" or "substantially rigid" are meant to also include the characteristic of an object or material to substantially hold its shape and/or volume when in an environment of a first pressure, but wherein the shape and/or volume may be altered in an environment of increased or decreased pressure. The amount of increased or decreased pressure needed to alter the shape and/or volume of the object or material may depend on the application desired for the material or object and may vary from application to application. In one embodiment, at least a portion of a liner may be rigid or substantially rigid, and at least a portion of the liner is subject to collapse under pressure dispensing conditions by application of a pressurized fluid to or against at least a portion of such a liner. In one embodiment, a rigid or substantially rigid collapsible liner may be fabricated of material of sufficient thickness and composition for the liner to be self-supporting when filled with liquid. A rigid or substantially rigid collapsible liner may be of single-wall or multi-wall character, and preferably comprises polymeric materials. Laminated composites of multiple layers of polymeric materials and/or other materials (e.g., laminated by application of heat and/or pressure) may be used. A rigid or substantially rigid collapsible liner may be formed by any one or more suitable lamination, extrusion, molding, shaping, and welding steps. A rigid or substantially rigid collapsible liner preferably has a substantially rigid opening or port integrally formed with the liner, thus avoiding the need for a separate fitment to be affixed to the liner by welding or other sealing methods. Dispensing assemblies and dispensing apparatuses as disclosed herein may be used with rigid or substantially rigid collapsible liners.

A collapsible liner may be disposed in a substantially rigid container (also known as a housing or overpack), which can be of a generally cylindrical shape, of a rectangular parallelepiped shape to promote stackability, or of any other suitable shape or conformation.

A generally rigid housing may also include an overpack lid that is leak-tightly joined to walls of the housing, to bound an interior space containing the liner. An interstitial space provided between the liner and surrounding container may be in fluid communication with a pressurized gas source, such that addition of pressurized gas to the interstitial space compresses the liner to cause liquid to be expelled from the liner.

For semiconductor manufacturing applications, liquid-containing material contained in a liner of a pressure dispensing container as disclosed herein should have less than 75 particles/milliliter (more preferably less than 50, still more preferably less than 35, and more preferably less than 20 particles/milliliter), of particles having a diameter of 0.20 microns or larger, at the point of fill of the liner, and the liner should have less than 30 (more preferably less than 15) parts per billion total organic carbon (TOC) in the Liquid, with less than 10 parts per trillion metal extractable levels per critical elements, such as calcium, cobalt, copper, chromium, iron, molybdenum, manganese, sodium, nickel, and tungsten, and with less than 150 parts per trillion iron and copper extractable levels per element for liner containment of hydrogen fluoride, hydrogen peroxide and ammonium hydroxide, consistent with the specifications set out in the Semiconductor Industry Association, International Technology Roadmap for Semiconductors (SIA, ITRS) 1999 Edition.

Liner-based liquid containment systems can be employed for storage and dispensing of chemical reagents and compositions of widely varied character. Although the invention is hereafter described primarily with reference to storage and dispensing of liquid or liquid-containing compositions for use in the manufacture of microelectronic device products, it will be appreciated that the utility of the invention is not thus limited, but rather the invention extends to and encompasses a wide variety of other applications and contained materials. For example, such liquid containment systems have utility in numerous other applications, including medical and pharmaceutical products, building and construction materials, food and beverage products, fossil fuels and oils, agriculture chemicals, etc., where liquid media or liquid materials require packaging.

The term "microelectronic device" as used herein refers to resist-coated semiconductor substrates, flat-panel displays, thin-film recording heads, microelectromechanical systems, and other advanced microelectronic components. The microelectronic device may include patterned silicon wafers, flat-panel display substrates, polymeric substrates, or microporous/mesoporous inorganic solids.

In certain embodiments, liquid-containing material may be maintained in a liner and TO overlaid with headspace containing inert gas. In other embodiments, liquid-containing material may be maintained in a liner with a zero-headspace or near-zero headspace conformation. As used herein, the term "zero headspace" in reference to fluid in a liner means that the liner is totally filled with liquid medium, and that there is no volume of gas overlying liquid medium in the liner. The term "near zero headspace" as used herein in reference to fluid in a liner means that the liner is substantially completely filled with liquid medium except for a very small volume of gas overlying liquid medium in the liner, e.g., the volume of gas is less than 5% of the total volume of fluid in the liner, preferably being less than 3% of the total volume of fluid, more preferably less than 2% of the total volume of fluid and most preferably, being less than 1% of the total volume of fluid, or less than 0.5% of the total volume of fluid (or, expressed another way, the volume of liquid or liquid-containing material in the liner is greater than 95% of the total volume of the liner, preferably being more than 97% of such total volume, more preferably more than 98% of such total volume, even more preferably more than 99% of such total volume, and most preferably more than 99.5% of such total volume).

The greater the volume of headspace, the greater the likelihood that the overlying gas will become entrained and/or solubilized in the liquid medium, since the liquid medium will be subjected to sloshing, splashing and translation in the liner, as well as impact of the liner against the rigid surrounding container during transportation of the package. This circumstance may in turn result in the formation of bubbles (e.g., microbubbles) and particulates in the liquid medium, which degrade the liquid medium, and render it potentially unsuitable for its intended purpose. For this reason, in certain embodiments headspace may be minimized and preferably eliminated (i.e., in a zero or near-zero headspace conformation) with complete filling of the interior volume of the liner with liquid medium. In other embodiments, headspace may be necessary to accommodate expansion of contained material during shipment due to temperature variation, but headspace may be removed from the liner at the point of use prior to dispensation of liquid-containing material from the liner.

One aspect of the invention relates to a shippable liner-based liquid storage and dispensing apparatus including a dispense head with multiple passages and valves that permit the performance of multiple (and preferably all) of the following steps: purging of air, oxygen and/or moisture from the liner-based container through the dispense head; filling of the liner-based container with liquid-containing material through the dispense head; maintaining a small volume of inert gas (e.g., at pressure greater than ambient atmospheric pressure) in liner headspace during shipment; removing the inert gas from the liner through the dispense head at a point of use prior to dispensation; and pressure dispensing of liquid-containing material from the liner through the dispense head to a fluid-utilizing process. The dispense head preferably includes multiple quick connect fittings to permit fluid connections to be made in an air-containing (or oxygen-containing, moisture-containing, or other-contaminant-containing) environment with minimal or substantially zero ingress of undesired material(s), without requiring connections to be made in a vacuum environment, an inert gas environment, or other controlled environment The use of a single dispense head coupled to the container to perform the foregoing steps substantially reduces or eliminates ingress of potential contaminants or undesired material(s) at all points between filling and dispensation of high-purity liquid or other liquid-containing material.

Quick connect fittings (also known as quick connects or quick release couplings) are known in the fluid coupling arts, and are used to provide a fast, make-or-break connection of fluid transfer lines. Quick connect fittings are generally operated by hand and replace threaded or flanged connections, which generally require tools such as wrenches. When equipped with self-sealing valves, quick connect fittings will, upon disconnection, automatically contain any fluid in the line. That is, engagement of cooperative portion of a quick connect coupling having a self sealing valve will mechanically actuate a valve in one or both of the cooperating portions to open the valve when the coupling is made and close the valve when the coupling is broken.

In certain embodiments, a dispense head as disclosed herein may be directly coupled to a mouth of a liner-containing container. In other embodiments, a dispense head may be indirectly coupled to a mouth of a liner-containing container, such as by using an adapter intermediately arranged between the dispense head and the mouth portion of the container. Such an adapter may beneficially be used to engage and/or retain a fitment portion of a liner registered with the mouth of the container in order for the fitment to receive an insertion (e.g., probe) portion of the dispense head.

In certain embodiments, a liner-containing rigid container may be fabricated of non-porous metal (as opposed to potentially porous material such as certain polymers) to minimize or eliminate migration of ambient environment gas or vapor into the container. In certain embodiments, a dispense head as disclosed herein may comprise a body and/or probe fabricated of metal (e.g., stainless steel) to similarly minimize or eliminate migration of ambient environment gas or vapor.

In certain embodiments, a dispense head includes an insertion end (e.g., probe) including at least one sealing element (e.g., O-ring), wherein the insertion end is arranged for insertion into a liner fitment with the at least one sealing element arranged to sealingly engage an inner surface of the fitment In certain embodiments, a dispense head may include an integrated diptube or downtube extending downward into the interior of a liner and arranged to extract liquid-containing material from a lower (e.g., bottom) portion of the liner. In other embodiments, a dispense head may be arranged far mating with a diptube coupling that is intermediately arranged between an insertion end of a dispense head and a diptube.

In certain embodiments, a shippable liquid storage and dispensing apparatus includes substantially rigid container containing a collapsible liner with an interstitial space arranged between the liner and the container, and a dispense head arranged for coupling to a month portion of the container. The dispense head includes a liquid passage in fluid communication with the interior of the liner, a liner gas passage in fluid communication with the interior of the liner, and a pressurization gas passage in fluid communication with the interstitial space. The dispense head may further include a liquid valve contained by or coupled to the dispense head and in fluid communication with the liquid passage. The liquid valve may include or have associated therewith a liquid valve quick connect fitting, with the liquid valve arranged between the dispense head and the liquid valve quick connect fitting. The dispense head may further include a liner gas valve contained by or coupled to the dispense head and in fluid communication with the liner gas passage. The liner gas valve may include or have associated therewith a liner gas valve quick connect fitting, with the liner gas valve arranged between the dispense head and the liner gas valve quick connect fitting. The dispense head may additionally include a pressurization gas valve contained by or coupled to the dispense head and in fluid communication with the pressurization gas passage. The pressurization gas valve may include or have associated therewith a pressurization gas valve quick connect fitting, with the pressurization gas valve arranged between the dispense head and the liquid valve quick connect fitting.

In certain embodiments, at least a portion of each of the liquid valve, the liner gas valve, and the pressurization gas valve may be externally accessible along at least one exterior portion of the dispense head. In certain embodiments, at least one of the liner gas valve and the pressurization gas valve may embody or include a check valve. In certain embodiments, at least one of the liner gas valve, the liquid valve, and the pressurization gas valve may include manually or automatically operable valves of any suitable type (e.g., ball valves, needle valves, etc.) In certain embodiments, at least one of the liner gas valve, the liquid valve, and the pressurization gas valve may comprise a pneumatic valve, solenoid-operated valve, and/or servo-operated valve. In certain embodiments, at least one of the liquid valve and the pressurization gas valve may be arranged to modulate flow responsive to one or more control signals.

In certain embodiments, at least one of a liner gas valve, a liquid valve, and a pressurization gas valve may include a corresponding covering element or plug (e.g., subject to manual removal') arranged to cover and/or seal at least one opening associated with the respective valve. In certain embodiments, one or more quick connect fittings arranged in fluid communication with at least one of a liner gas valve, a liquid valve, and a pressurization gas valve may include a corresponding covering element or plug (e.g., subject to manual removal') arranged to cover and/or seal at least one opening associated with the respective quick connect fitting. Such covering elements) or plug(s) may be used to further prevent or reduce ingress of contaminants to fluid connection surfaces.

In certain embodiments, at least one protective housing or shroud arranged to cover at least a portion of at least one of the liquid valve, the liner gas valve, and the pressurization gas valve, and/or at least a portion of one or more quick connect fittings arranged in fluid communication a liner gas valve, a liquid valve, and/or a pressurization gas valve. Such a protective housing or shroud may comprise any suitable rigid and/or cushioning material(s) and be arranged to prevent damage to valves, quick connect fittings, and/or other portions or components of a dispense head during shipment. In certain embodiments, a protective housing or shroud may be arranged to encase all or substantially all otherwise externally accessible surfaces of a dispense head when the dispense head is coupled to a liner-based container. In one embodiment, a protective housing or shroud includes a foam cushioning material arranged within a rigid shell positionable around the dispense head when coupled to a liner-based container, and the housing or shroud may be arranged for attachment to an exterior of the container.

In certain embodiments, liquid-containing material may he arranged within a liner of a liner-based container to which a dispense head is coupled, and the liquid-containing material may be overlaid with inert gas (e.g., nitrogen, argon, or other suitable gas) at a slightly positive (greater than ambient atmospheric) pressure in order to prevent ingress of environmental gas and/or vapor into the container and/or dispense head. In certain embodiments, the headspace may contain pressurized gas at a pressure of at least 102 kPa, at least about 105 kPa, at least about 110 kPa, at least about 120 kPa, or any other suitable value greater than ambient atmospheric pressure likely to be experienced during shipment and/or dispensing use of the container.

In certain embodiments, a shippable dispense head may be arranged for mating with a substantially rigid container containing a collapsible liner with an interstitial space between the liner and the container, with a fitment of the liner registered with a mouth portion of the container. Such a dispense head may include: a dispense head body defining (i) a liquid passage and a liner gas passage arranged to permit fluid communication with an interior of the liner, and (ii) a pressurization gas passage in fluid communication with the interstitial space, wherein an insertion (e.g., probe) portion of the dispense head includes at least one sealing element insertable into the fitment to sealingly engage a portion of the fitment A terminus of the liner gas passage may be arranged below the at least one sealing element to permit fluid communication with an upper portion of the liner. A dip tube may extend past the fitment into the interior of the liner. The liquid passage may extend to or through the dip tube to permit extraction of fluid material from a lower portion of the liner. A liner gas valve within or associated with the dispense head may be provided in fluid communication with the liner gas passage. A liquid valve within or associated with the dispense head may be provided in fluid communication with the liquid passage. The liner gas valve may include or have associated therewith a liner gas valve quick connect fitting, with the liner gas valve arranged between the dispense head and the liner gas valve quick connect fitting. The dispense head may additionally include a pressurization gas valve contained by or coupled to the dispense head and in fluid communication with the pressurization gas passage. The pressurization gas valve may include or have associated therewith a pressurization gas valve quick connect fitting, with the pressurization gas valve arranged between the dispense head and the liquid valve quick connect fitting.

A pressurization gas valve within or associated with the dispense head may be provided in fluid communication with the pressurization gas passage. In certain embodiments, the liquid passage and the liner gas passage may be non-concentrically arranged within at least the insertion portion of the dispense head. A diptube coupling may be arranged between the probe or insertion portion of the dispense head and the diptube. A fitment of the liner may be registered with a mouth portion of the container. An adapter may be intermediately arranged between the dispense head and the mouth portion of the container to permit indirect coupling of the dispense head to the mouth portion of the container.

In certain embodiments, a fluid handling method may utilize a substantially rigid container containing a collapsible liner and a dispense head coupled to a mouth of the container and comprising a liquid passage in fluid communication with an interior of the liner, a liner gas passage in fluid communication with the interior of the liner, a pressurization gas passage in fluid communication with an interstitial space between the liner and the container, a liquid valve in fluid communication with the liquid passage, a liner gas valve in fluid communication with the liner gas passage, and a pressurization gas valve in fluid communication with the pressurization gas passage. The fluid handling method may include two or more of the following steps; supplying inert gas through the dispense head to an interior of the liner; following the inert gas supplying step, removing inert gas from the interior of the liner through the dispense head to at least partially deflate the liner; following the inert gas removing step, at least partially re-inflating the liner with inert gas; following the liner re-inflating step, supplying a liquid-containing material through the dispense head to at least partially fill the interior of the liner with the liquid-containing material while allowing at least a portion of the inert gas within the liner to escape through the dispense head; and following the liquid-containing material supplying step, closing the liquid supply valve. In certain embodiments, headspace (e.g., headspace gas) may be removed from the liner thereafter, and valves associated with the liner may be closed to permit the liner to remain in a zero headspace condition for any desired time period. When it is time to prepare the liner for shipment, pressurized inert gas (i.e., pressurized to any suitable pressure value, such as 102 kPa or any other pressure value disclosed herein) may be supplied to the liner through the dispense head (e.g., through the liner gas valve), and such pressurized inert gas may remain in the liner overlying the liquid-containing material during shipment to a point of use.

In certain embodiments, various steps may be performed after shipment of an inert-gas-pressurized liner-based package to a point of use. One or more steps may include; connecting a pressurized gas supply line and a liquid dispensing line to the dispense head at a point of use; removing the additional inert gas from the liner through the dispense head; supplying pressurized gas from the pressurized gas supply line through the dispense head to an interstitial space between the liner and the dispense head; and dispensing liquid-containing material through the dispense head and the liquid dispensing line to a fluid-utilizing apparatus arranged to utilize the liquid-containing composition.

In certain embodiments, the liquid-containing material comprises any of the following: photoresists, etchants, chemical vapor deposition reagents, solvents, wafer cleaning formulations, tool cleaning formulations chemical mechanical polishing compositions, color filtering chemistries, overcoats, and liquid crystal material.

In certain embodiments, a fluid handling method may utilizing a substantially rigid container containing a collapsible liner and a dispense head coupled to a mouth of the container and comprising a liquid passage in fluid communication with an interior of the liner, a liner gas passage in fluid communication with the interior of the liner, a pressurization gas passage in fluid communication with an interstitial space between the liner and the container, a liquid valve in fluid communication with the liquid passage, a liner gas valve in fluid communication with the liner gas passage, and a pressurization gas valve in fluid communication with the pressurization gas passage. Such method may include two or more of the following steps: supplying inert gas through the dispense head to an interior of the liner; following the inert gas supplying step, removing inert gas from the interior of the liner through the dispense head to at least partially deflate the liner; following the inert gas removing step, at least partially re-inflating the liner with inert gas; following the liner re-inflating step, supplying a liquid-containing material through the dispense head to at least partially fill the interior of the liner with the liquid-containing material while allowing at least a portion of the inert gas within the liner to escape through the dispense head; and following the liquid-containing material supplying step, closing the liquid supply valve. Quick connect fittings may be associated with one or more of the pressurization gas valve, the liquid valve, and the liner gas valve. In certain embodiments, connecting the pressurized gas supply line to the dispense head may utilize a pressurization gas valve quick connect fitting, and connecting the liquid dispensing line to the dispense head may utilize a liquid dispensing valve quick connect fining.

Further details of exemplary embodiments are explained below in connection with the figures.

FIG. 1A illustrates components of a fluid handling system 100 arranged for filling a shippable liquid storage and dispensing apparatus including a liner-based pressure dispense package 105 according to one embodiment. The package 105 includes a rigid or substantially rigid container 110 containing a collapsible liner 120 with an interstitial space 115 arranged between the container 110 and the liner 120. The liner 120 bounds an interior volume 121 that may include a liquid-containing material 122 overlaid with headspace 123 that may include inert gas, A dispense head 130 is coupled to the container 110. A dispense head body 131 defines a pressurization gas passage 132, a liquid passage 133, and a liner gas passage 134. The pressurization gas passage 132 is in fluid communication with the interstitial space 115 (e.g., at gas delivery point 132A). The liquid passage 133 extends through a dip tube 135 in fluid communication with the interior 121 of the liner 120 (e.g., to extract liquid-containing material at an extraction point 135A arranged in a lower portion or along a bottom portion of the liner 120). The liner gas passage is in fluid communication with the interior 121 of the liner (e.g., at gas ingress or egress point 134A arranged at an upper portion of the liner 120). A pressurization gas valve 142, part of, contained by or coupled with the dispense head 130 is in fluid communication with the pressurization gas passage 132. A liquid valve 143, part of, contained by, or coupled with the dispense head 130, is in fluid communication with the liquid passage 133. A liner gas valve 144, part of, contained by, or coupled with the dispense head 120, is in fluid communication with the liner gas passage 134. At least one (end preferably each of) the pressurization gas valve 142, liquid valve 143, and liner gas valve 144 includes or has associated therewith a corresponding quick connect fitting—namely, a pressurization gas valve quick connect fitting 152, a liquid valve quick connect fitting 153, and/or a liner gas valve quick connect fitting 154. The pressurization gas valve 142 is arranged to receive pressurized gas from a pressurization gas source 172 (which may include a gas regulator and/or gas control valve(s) (not shown)). The liquid valve 143 is arranged to receive liquid material (e.g., as part of a liner filling process) from a liquid material source 173, optionally through an intermediate liquid valve 175. The liner gas valve 144 is arranged to be in selective fluid communication with a vacuum source or vent 174A (e.g., through vacuum/vent valve 176A) or an inert gas source 174B (e.g., through inert gas valve 176B). Operation of various components of the system 100 may be controlled with a controller 101.

The system 100 may be used to perform some or all of the following steps: purging of air, oxygen and/or moisture from the liner-based container through the dispense head; filling the liner-based container with liquid-containing material through the dispense head; adding (and retaining) a small volume of inert gas (e.g., at pressure greater than ambient atmospheric pressure) to the liner headspace to prepare the package 105 for shipment.

In one embodiment, a new liner 120 that is nominally 'empty' of liquid-containing material, but subject to presence of oxygen and/or vapor, is inserted into a container 110, and a dispense head 130 is coupled to the container 110, with the dispense head 130 coupled to a pressurization gas source 172, coupled to a liquid material source 173, and selectively coupled to a vacuum source/vent 174A or inert gas source 174B as shown in FIG. 1A. To prepare the liner for filling with liquid-containing material, inert gas is supplied to the interior 121 of the liner 120 from the inert gas source 174B, and such inert gas is removed using the vacuum source or vent 174A (with the inert gas supply and removal constituting one purge cycle). Multiple purge cycles may be performed (each including addition of inert gas followed by removal of insert gas) to ensure removal of any non-inert gas and vapor from the interior 121 of the liner 120. Thereafter, liquid-containing material 122 may be supplied to the liner from the liquid material source 173 through the liquid valve 143, passage 133, and dip tube 135. Headspace may be removed from the interior 121 using the vacuum source or vent 174A. The dispense head 130 may optionally be sealed for any desired period of time until shipment of the package 105 is desired. To prepare the package 105 for shipment, pressurized inert gas may be supplied to a headspace portion 123 of the liner from the inert gas source 174B through the liner gas valve 144 and liner gas passage 134, and the dispense head 130 may be sealed thereafter for shipment of the package 105 (with pressurized contents therein) to a liquid-material utilizing facility.

Figure 1B:
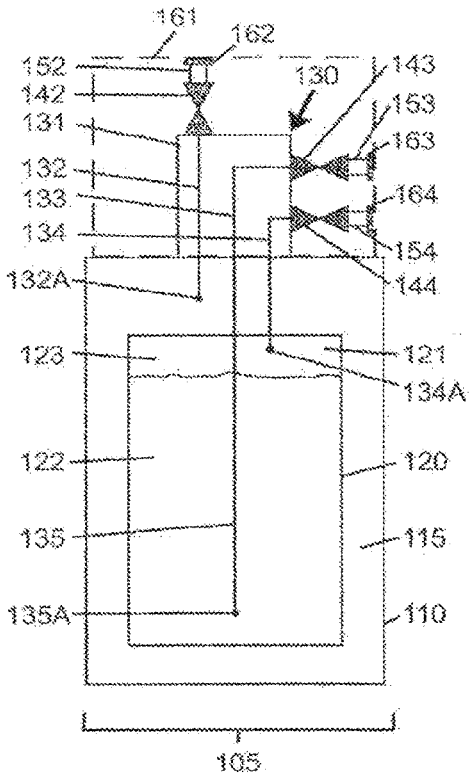
FIG. 1B is a simplified schematic view of a shippable liquid storage and dispensing apparatus including a liner-based pressure dispense package following filling of the package using a fluid handling system according to FIG. 1A.
Figure 1C:
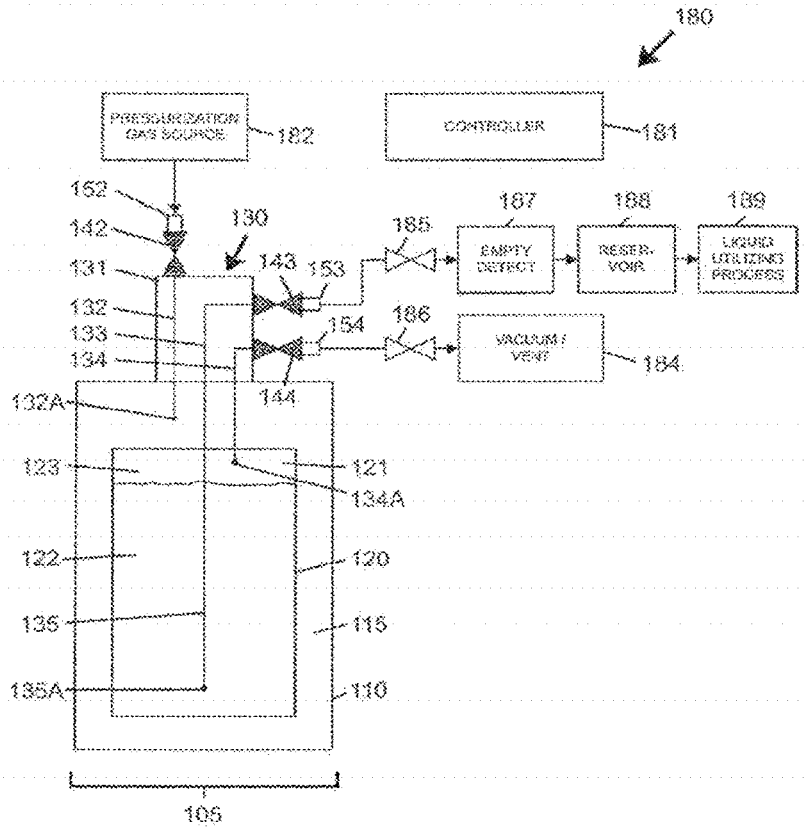
FIG. 1C is a simplified schematic view of a fluid handling system arranged for dispensing a liquid-containing material including shippable liquid storage and dispensing apparatus including a liner-based pressure dispense package according to FIG. 1B.

FIG. 1B illustrates the shippable liquid storage and dispensing apparatus including a liner-based pressure dispense package 105 after filling of the package 105 using the fluid handling system 100 described in connection with FIG. 1A. After filling the liner 120 of the package 105 with liquid-containing material 122 overlaid with pressurized inert gas 123, the valves 142, 143, 144 may be closed (either automatically or manually), and optional covering elements or plugs 162, 163, 164 may be arranged to cover at least one opening associated with each valve 142, 143, 144 and/or associated quick connect fittings 152, 153, 154. Additionally, at least one protective housing or shroud 161 may be arranged to cover at least a portion of at least one of (and preferably the entirety of each of) the dispense head 130, the valves 142, 143, 144, and the quick connect fittings 152, 153, 154, to help protect such components from damage during shipment. Such a shroud may be an extended chime welded to the container portion that extends axially beyond the top of the dispense head FIG. 1C illustrates components of a fluid handling system 180 arranged for dispensing a liquid-containing material from the shippable liquid storage and dispensing apparatus including the liner-based pressure dispense package 105. At a point of use, the covering elements or plugs 162, 163, 164 and the protective housing or shroud 161 (illustrated in FIG. 1B) may be removed, and multiple connections may be made to the dispense head 130. The pressurization gas valve 142 (and associated quick connect fitting 152) may be connected to piping associated with a pressurization gas source 182 (which may include at least one pressure regulator and/or valve (not shown)). The liquid valve 143 (and associated quick connect fitting 153) may be connected to piping associated with a liquid-utilizing process 189 (optionally by way of a downstream liquid valve 185), with the liquid-utilizing process 189 (such as process tool) optionally including an empty detect element 187 and/or a reservoir 188. The liner gas valve 144 (and associated quick connect fitting 154) may be connected to piping associated with a vacuum source and/or vent 184, optionally including a vacuum/vent valve 186. A controller 181 may be arranged to control one or more components of the fluid handling system 180.

In operation of the fluid handling system 180, any inert gas 123 contained in the interior 121 of the Liner 120 may be removed by opening the finer gas valve 144 and withdrawing gas through the liner gas valve 144 using a vacuum source 184, or by supplying pressurized gas to the interstitial space 115 to compress the liner 120 and expel gas through the liner gas valve 144 to a vent 184. Alternatively, inert gas 123 may be removed through the liquid valve 143 by expelling gas into a ventable reservoir 188 arranged between the package 105 and a downstream liquid utilizing process 189. The reservoir 188 may include a gas vent (not shown) that is periodically vented from an upper portion of the reservoir 188 to permit inert gas to escape, with liquid-containing material withdrawn from a lower portion of the reservoir 188 to convey liquid to the downstream liquid-utilizing process 189.

Although the preceding paragraph referred to removal of inert gas 123 from the liner 120, in certain embodiments liquid-containing material 122 may be arranged in a liner 120 in a zero-headspace condition without presence of any inert gas in the interior 121 of the liner 120.

After removal of any inert gas 123 from the liner 120, liquid-containing material 122 may be dispensed from the liner 120 by opening the liquid valve 143 and supplying pressurized gas (or other fluid) to the interstitial space 115 to compress the liner 120 and force liquid through the dip tube 135 and the liquid valve 143 into piping and components associated with the downstream liquid-utilizing process 189. One or more empty detect sensors 187 of any suitable type(s) may be arranged in piping associated with the liquid-utilizing process. In certain embodiment; the empty detect sensor(s) may include at least one of a bubble sensor, a capacitive sensor, a flow meter (e.g., integrating or totalized flow meter to meter aggregated flow of liquid containing material through the meter), or a pressure transducer or pressure switch arranged to sense a pressure droop condition as indicative of an empty or an approaching empty condition. Use of pressure transducers or pressure switches to sense pressure droop conditions are disclosed in U.S. Patent Application Publication No. 2010/0112815 A1, which is hereby incorporated by reference herein. After an empty condition or an approach to empty condition is sensed, dispensing of liquid-containing material 122 from the liner 120 may be suspended, and continued dispensing of liquid-containing material may be initiated from another liner-based pressure dispense package (not shown) to the liquid-utilizing process 189. In certain embodiments, liquid-containing material may continue to be supplied to the liquid-utilizing process from an optional downstream reservoir 188 while a new liner-based pressure dispense container is readied for dispensing operation.

Figure 2A:
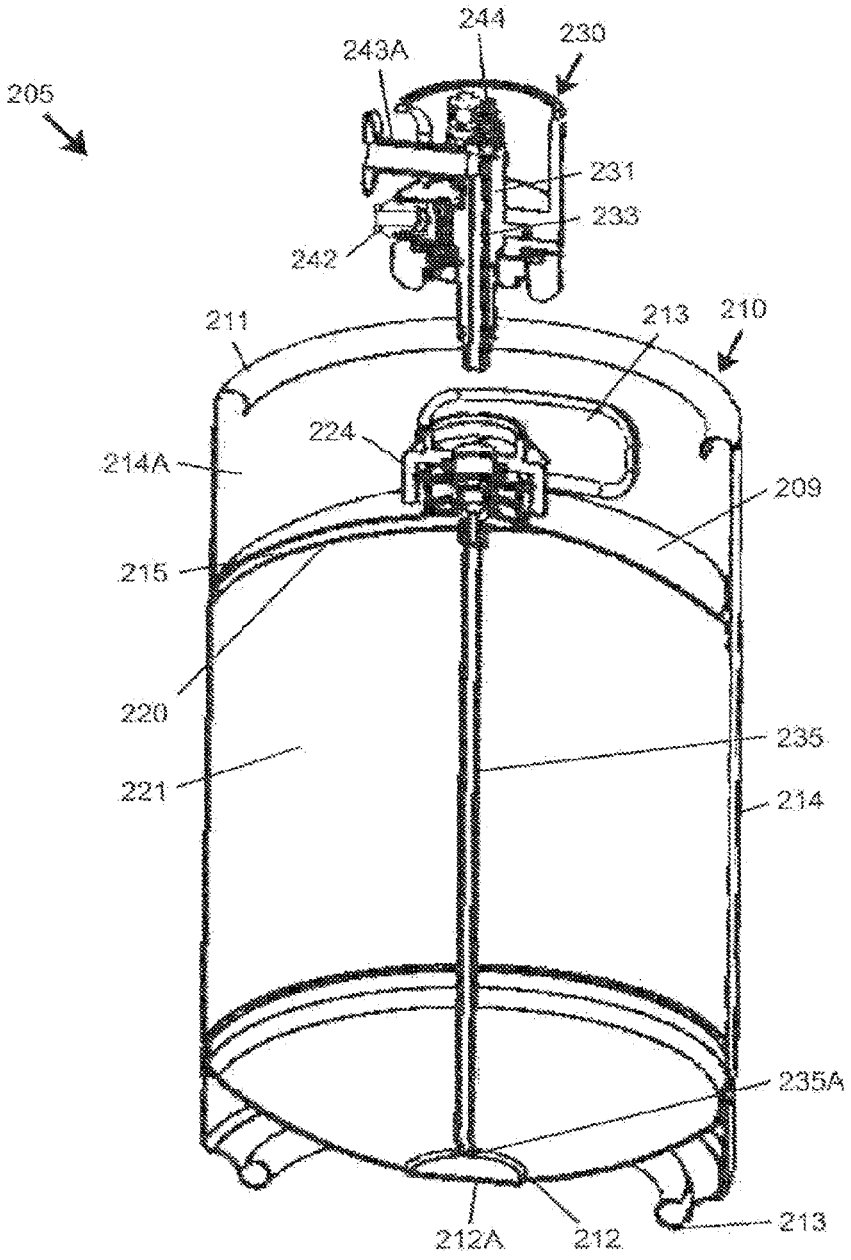
FIG. 2A is a cross-sectional perspective assembly view including components of a shippable liquid storage and dispensing apparatus including a liner-based pressure dispense package according to embodiments of the present invention.
Figure 2B:
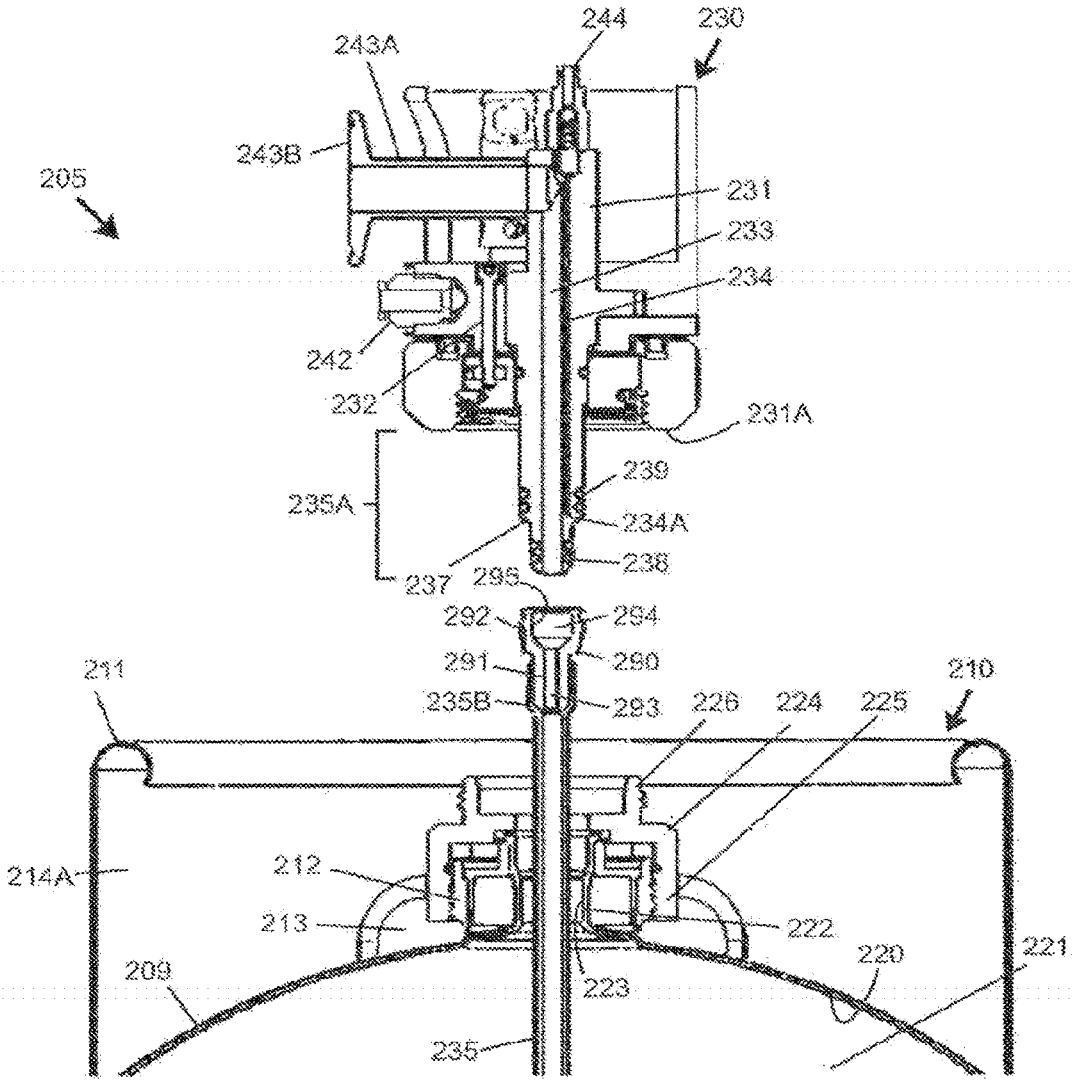
FIG. 2B is a side cross-sectional partial assembly view of components of the shippable liquid storage and dispensing apparatus of FIG. 2A.
Figure 2C:
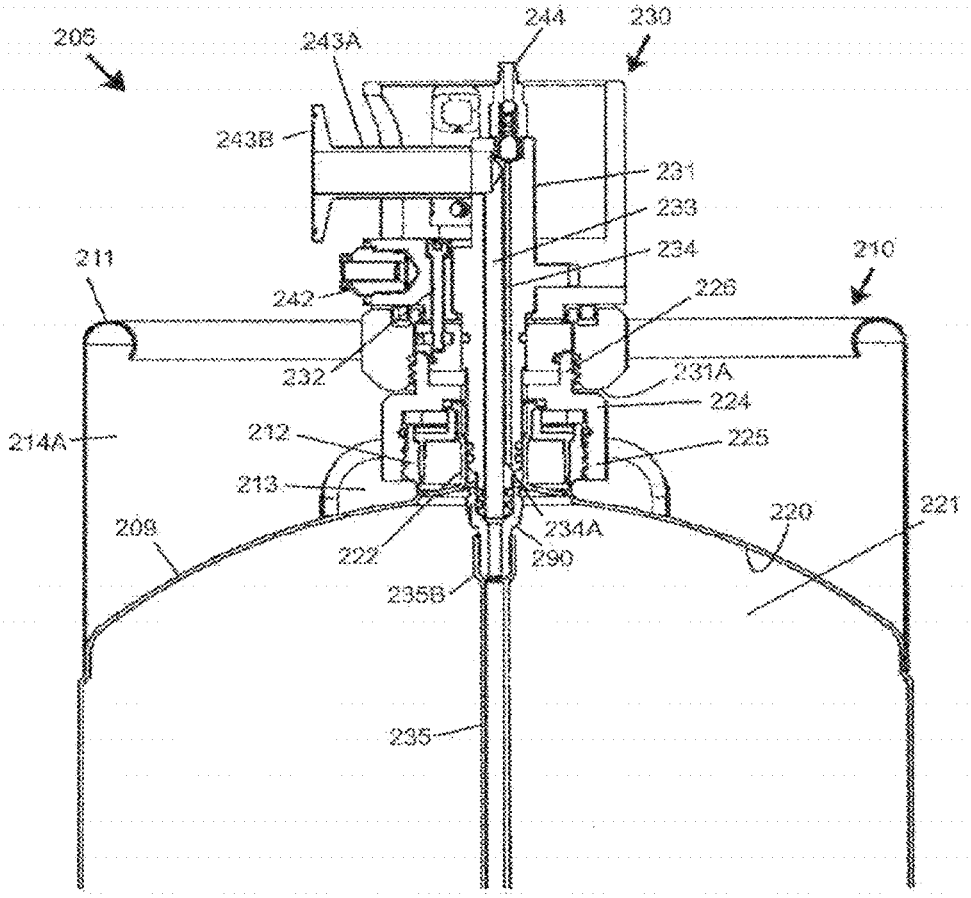
FIG. 2C is a side cross-sectional view of assembled components of the shippable fluid and storage dispensing apparatus of FIGS. 2A-2B.

FIG. 2A-2C illustrate component of a first shippable liquid storage and dispensing apparatus 205, including a dispense head 230 arranged for coupling to a container 210 containing a liner 220 therein. An interstitial space 215 is provided between the container 210 and the liner 220. The container 210 includes a threaded mouth 212 centrally arranged along an upper boundary wall 209, includes at least one side wall 214 with an upper portion 214A, configured as a chime, extending above the boundary wall 209 terminating at an upper rim 211, includes a bottom wall 212 optionally including a well region 212A, and includes a lower rim 213 arranged to support the container 210. The upper portion 214A of the at least one side wall 214 may include at least one opening 213 serving as a handle for manual grasping of the container 210. In certain embodiments, the container 210 may be fabricated of metal (e.g., stainless steel).

A liner 220 defining an interior volume 221 is arranged within the container 210. A fitment 222 defining an aperture bounded by an inner surface 223 is joined to the liner 220, with the fitment 222 being registered with a mouth 212 of the container and retained in position with an adapter 224 that includes a lower portion 225 having a female threaded surface arranged to engage the mouth 212, and that includes an upper portion 226 having a male threaded portion arranged to engage female threads arranged along a lower surface 231A of the dispense head 230.

A hollow diptube 235 having an open lower end 235A and a flared upper end 235B is arranged for insertion into the interior 221 of the liner 220. The diptube 235 is arranged to be joined to a diptube coupling 290. The diptube coupling 290 includes a reduced diameter lower portion 291 defining a bore 293 and arranged for insertion into the flared upper end 235B of the diptube 235, and includes an increased diameter upper portion 292 defining a recess 294 bounded by an inner surface 295 arranged to engage a tip of a probe or insertion portion 235A and at least diptube sealing element 238 of the dispense head 230.

In certain embodiments, a diptube without a flared upper end may be used; such a diptube may be accomplished either by pushing the diptube to lock in the bore of a coupling, or by molding a coupling over the diptube.

The dispense head 230 includes a body 231 defining a pressurization gas passage 232, a liquid passage 233, and a liner gas passage 234. The pressurization gas passage 232 is in fluid communication with a pressurization gas valve 242, to selectively permit pressurized gas to enter the interstitial apace 215. The liquid passage 233 is in fluid communication with a liquid valve interface coupling 243A having an external face 243B arranged for mating with a liquid valve (not shown). The liner gas passage 234 is in fluid communication with a liner gas valve 244. A downwardly-protruding probe or insertion portion 235 extends beyond a lower surface 231A of the dispense head 230 and is arranged for insertion into the fitment 222, with a tip portion of the probe or insertion portion 235A and diptube sealing element(s) 238 being arranged for mating with the inner surface 295 of the recess 294 defined in the diptube coupling 290. One or more additional sealing elements 239 are arranged along an exterior surface of the probe or insertion portion 235A for sealing engagement with the inner surface 223 of the fitment 222 of the liner 220. The liner gas passage 234 includes a terminus 234A (proximate to shoulder 237 intermediately arranged along the insertion portion 235A) arranged above the diptube coupling 290 and arranged for fluid communication with the interior 221 of the liner 220 when the dispense head 230 is coupled with the mouth 212 (e.g., indirectly coupled via the adapter 224) of the container 210. The liquid passage 233 extends through the dispense head 230 and the diptube coupling 290 through the diptube 235 in order to permit liquid-containing material to be withdrawn from a lower (e.g., bottom) portion of the Liner 220 (e.g., proximate to the well portion 212A defined in the bottom wall 212 of the container 210).

As shown in FIGS. 2A-2C, the valves 242, 244 are arranged in or on the dispense head 230 and are further arranged so as not to extend beyond the width of the upper rim 211 of the container 210. The container 210, liner 220, and dispense head 230 may be used to perform liquid handling methods as disclosed herein.

Figure 3A:
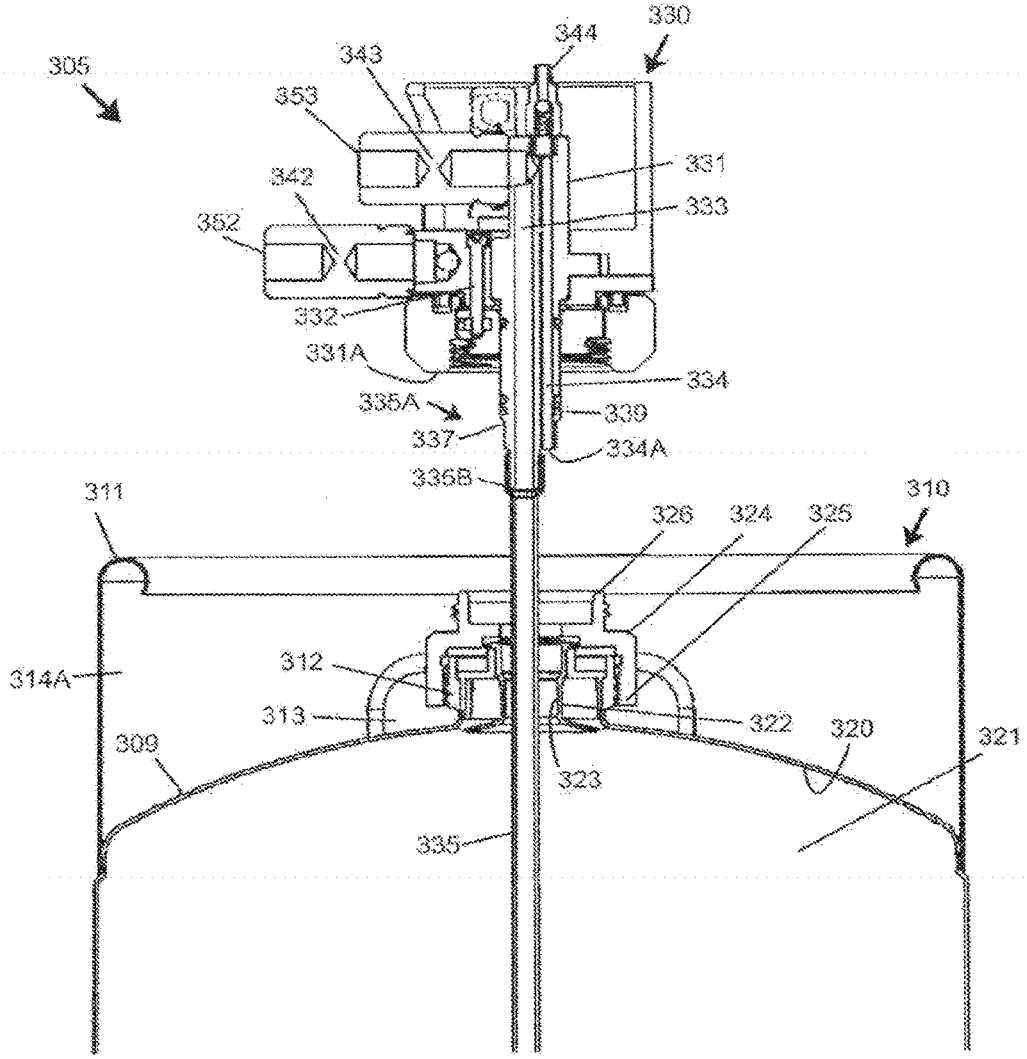
FIG. 3A is a side cross-sectional partial assembly view of components of another shippable liquid storage and dispensing apparatus including a liner-based pressure dispense according embodiments of the present invention.
Figure 3B:
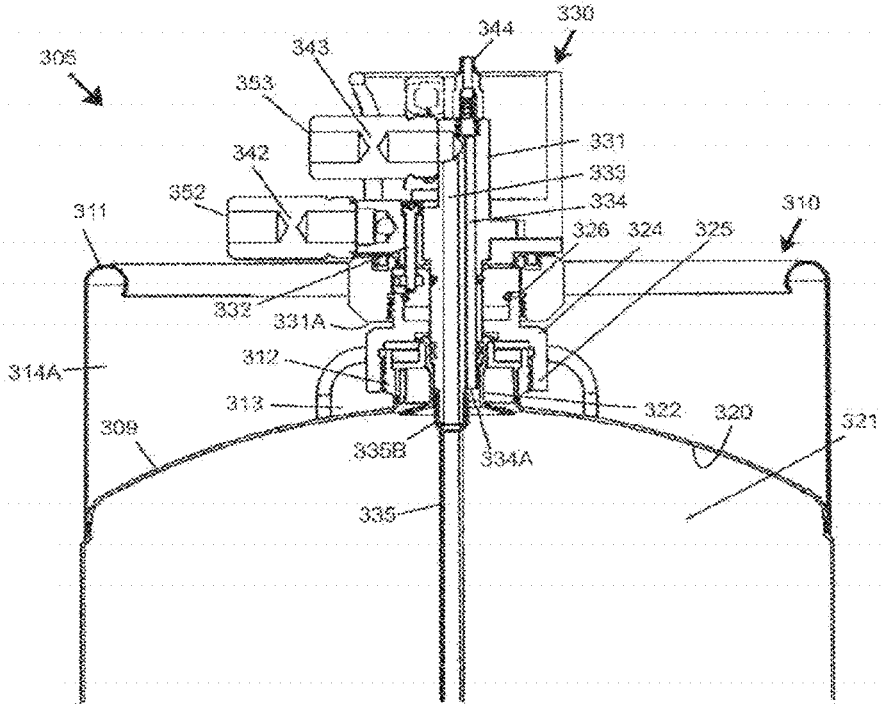
FIG. 3B is a side cross-sectional view of assembled components of the shippable fluid and storage dispensing apparatus of FIG. 3A.
Figure 4:
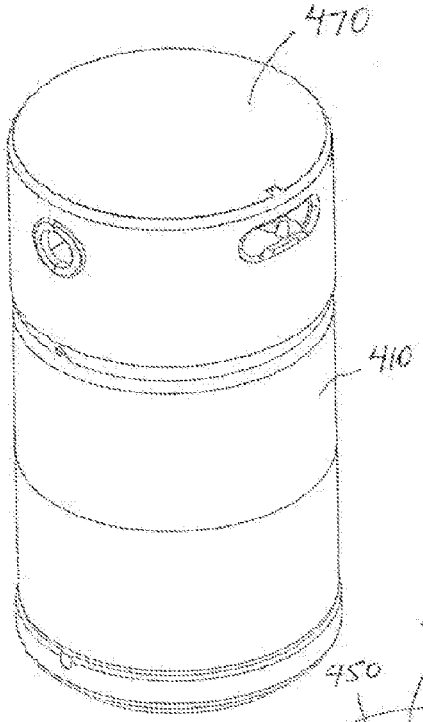
FIG. 4 is a perspective view of a a shippable liquid storage and dispensing apparatus including a liner-based pressure dispense package with a cover. The view from the opposite side being the same.
Figure 5:
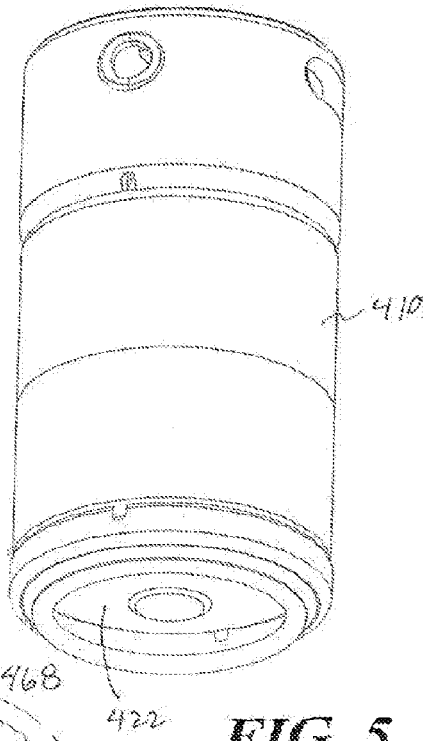
FIG. 5 is a perspective view of the shippable liquid storage and dispensing apparatus including a liner-based pressure dispense package of FIG. 4 viewing the bottom. The view from the opposite side being the same.
Figure 6:
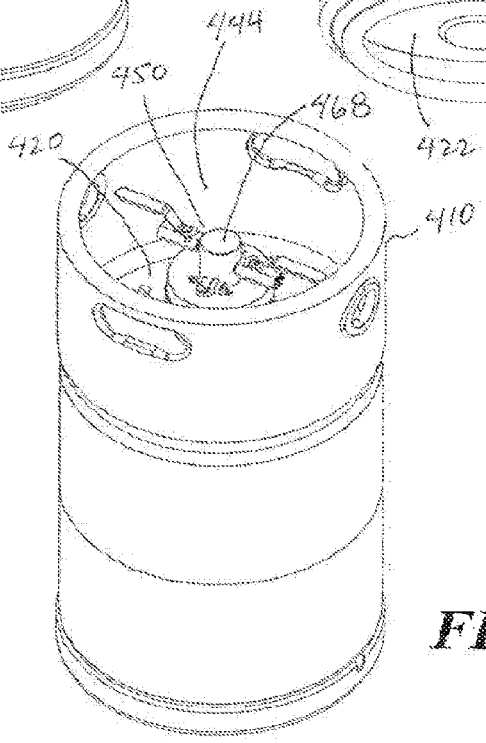
FIG. 6 is a perspective view of the shippable liquid storage and dispensing apparatus including a liner-based pressure dispense package of FIG. with the cover removed.
Figure 7:
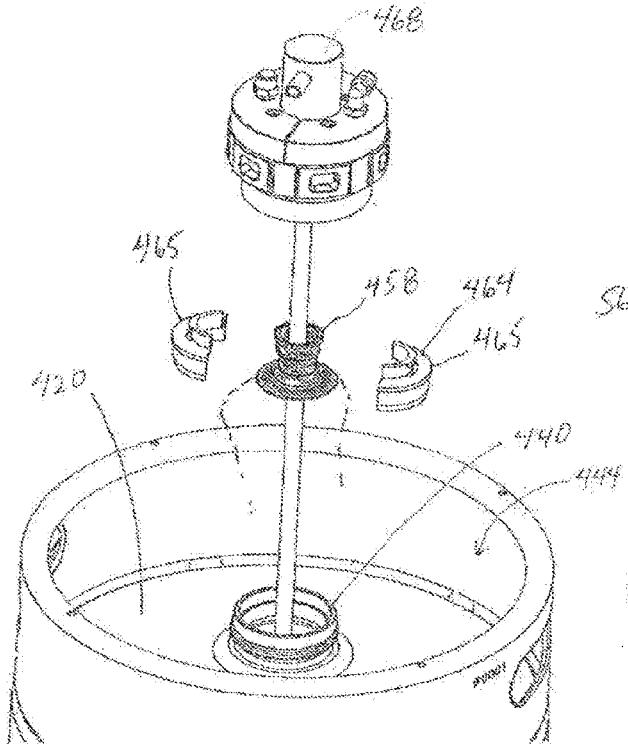
FIG. 7 is a partial exploded view of the dispense system of FIG. 4-6 illustrating the downtube, liner fitting, and a liner retainer.
Figure 8:
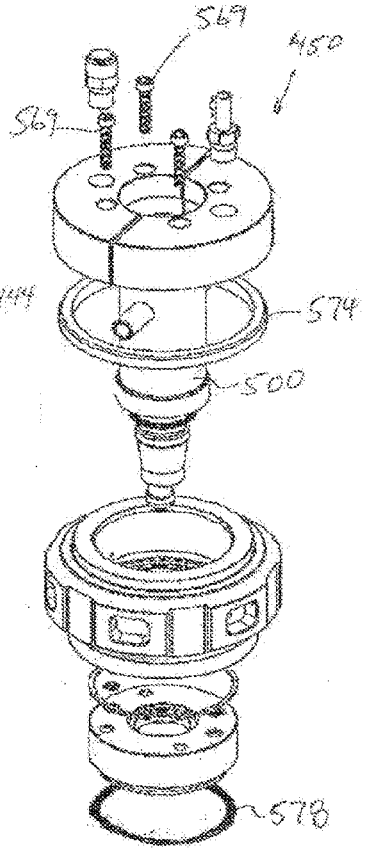
FIG. 8 is an exploded view of a dispense head according to embodiments of the invention.
Figure 9:
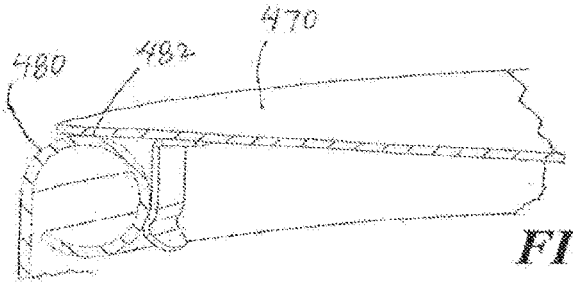
FIG. 9 is a cross sectional view showing an attachment of the cover to the upper chimes.
Figure 10:
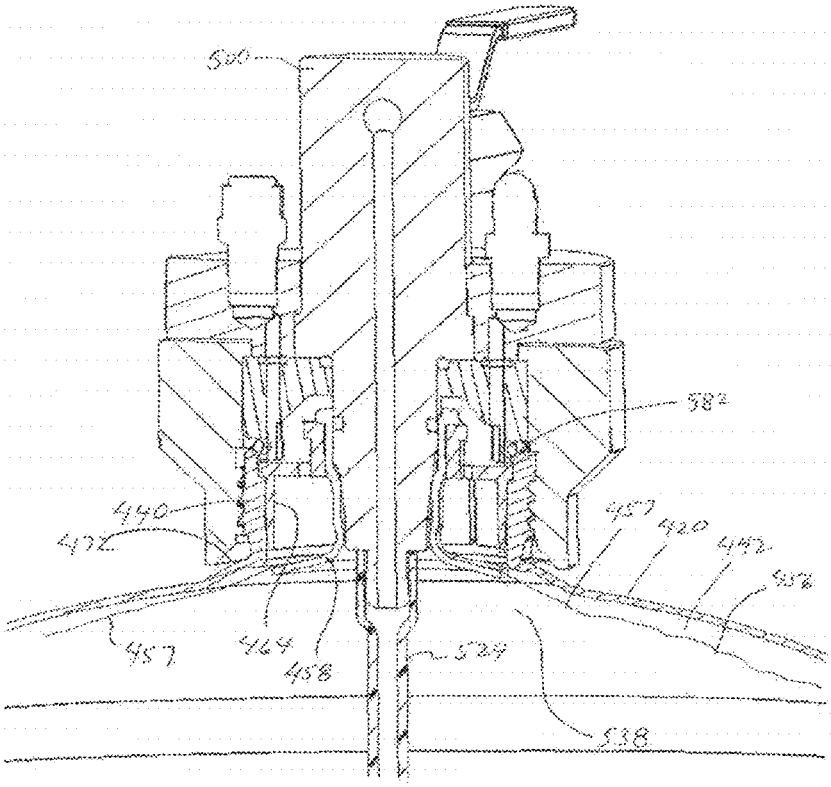
FIG. 10 is a cross sectional view of a dispense head installed in a container with the liner and down tube.
Figure 11A:
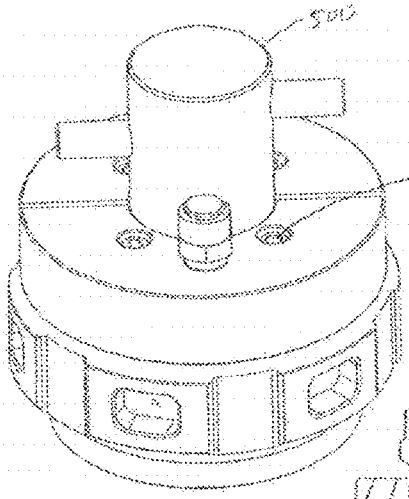
FIG. 11A is a perspective view of a dispense head according to an embodiment of the invention.
Figure 11B:
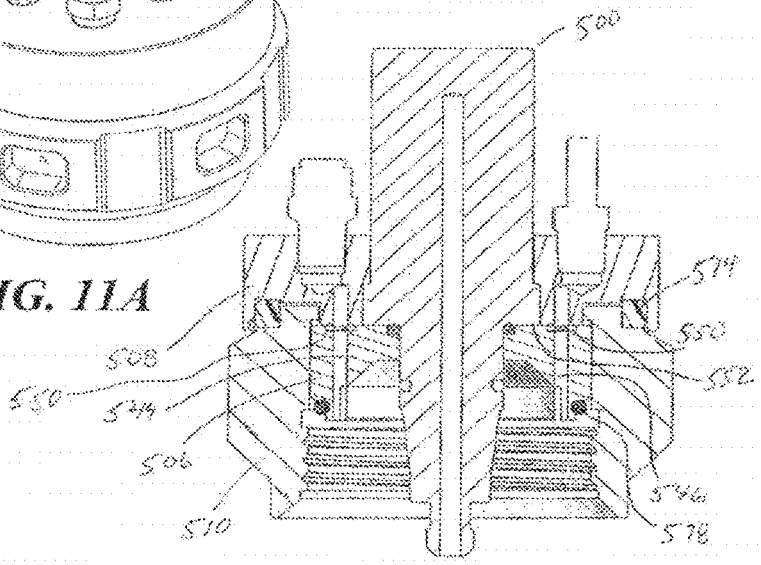
FIG. 11B is a cross sectional view of the dispense head of FIG. 11A.
Figure 12A:
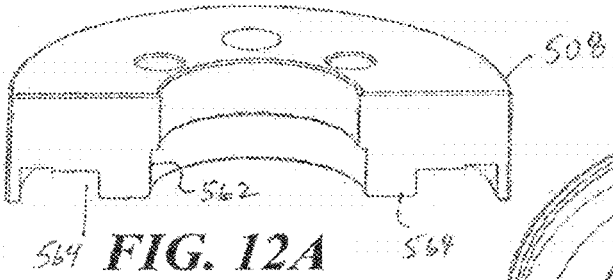
FIG. 12A is a perspective view of a upper body portion half of the dispense head.
Figure 12B:
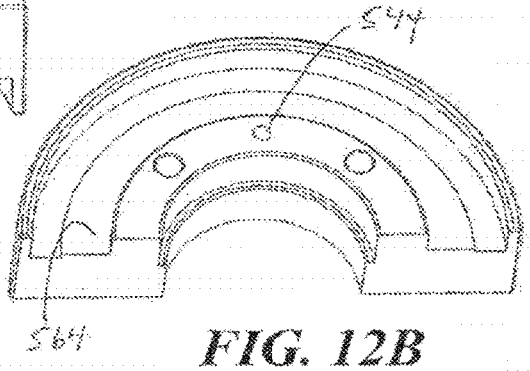
FIG. 12B is a perspective view of the lower side of the body portion half of FIG. 12A.
Figure 13A:
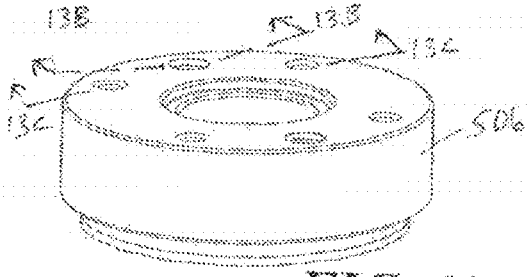
FIG. 13A is a perspective view of a lower body portion of the dispense head.
Figure 13C:
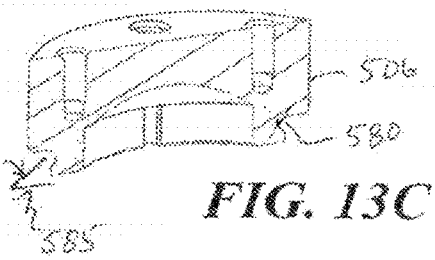
FIG. 13C is a cross sectional view at line 13C-13C of FIG. 13A.
Figure 13B:
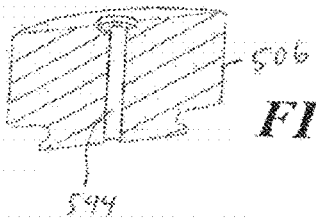
FIG. 13B is a cross sectional view at line 13B-13B of FIG. 13A.
Figure 14:
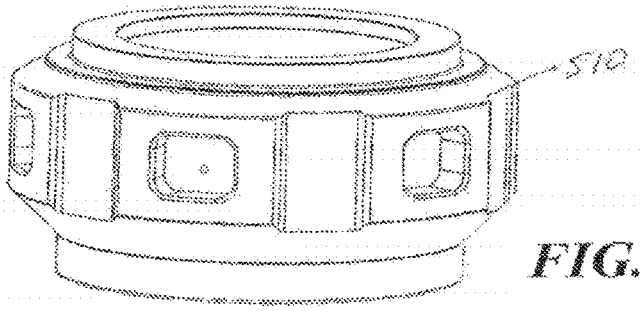
FIG. 14 is a perspective view of the nut of the dispense head.

FIGS. 3A-3B illustrate components of a second shippable liquid storage and dispensing apparatus 305 including a dispense head 330 arranged for coupling to a container 310 containing a liner 320 therein. The apparatus 305 is similar in many respects to the apparatus 205 disclosed in connection with FIGS. 2A-2C, but with different liquid and pressurization gas valves, and with a different liner gas passage and diptube arrangement (e.g., lacking a diptube coupling).

As shown in FIGS. 3A-3B a dispense head 330 is arranged for coupling to container 310 including a finer 320 therein. The container 310 includes a threaded mouth 312 centrally arranged along an upper boundary wall 309, includes at least one side wall with an upper portion 314A extending above the boundary wall 309 terminating at an upper rim 311, and includes a bottom wall and lower rim (now shown). The upper portion 314 of the at least one side wall may include at least one opening 313 serving as a handle for manual grasping of the container 310. In certain embodiments, the container 310 may be fabricated of metal (e.g., stainless steel).

A liner 320 defining an interior volume 321 is arranged within the container 310. A fitment 322 defining an aperture bounded by an inner surface 323 is joined to the liner 320, with the fitment 322 being registered with a mouth 312 of the container and retained in position with an adapter 324. The adapter 324 includes a lower portion 325 having a female threaded surface arranged to engage the mouth 312, and includes an upper portion 326 having a male threaded portion arranged to engage female threads arranged along a lower surface 331A of the dispense head 330.

A hollow diptube 335 having an open lower end and a flared upper end 335B portion is directly affixed to the probe or insertion portion 335A extending beyond a lower surface 331A of the dispense head 330, with a liner gas passage 334A arranged proximate to the flared upper end 335B of the diptube 335 and arranged below at least one sealing element 339 suitable for sealing engagement with an inner surface 323 of the fitment 322. The diptube 335 is arranged for insertion through the fitment 322. into the interior 321 of the liner 320, with sealing element(s) 339 along an exterior surface of the probe or insertion portion 335 arranged to sealingly engage the inner surface 323 of the fitment 322. The liquid passage 333 and the liner gas passage 334 are non-concentrically arranged within at least the probe or insertion portion 335A of the dispense head 330.

The dispense head 330 includes a body 331 defining a pressurization gas passage 332, a liquid passage 333, and a liner gas passage 334. The pressurization gas passage 332 is in fluid communication with a pressurization gas valve 342 having an associated pressurization gas valve quick connect 352. The liquid passage 333 is in fluid communication with a liquid valve 343 having an associated liquid valve quick connect 353. The liner gas passage 334 is in fluid communication with a liner gas valve 344. The liner gas passage 334 includes a terminus 334A arranged above the diptube coupling 390 and arranged for fluid communication with the interior 321 of the liner 320 when the dispense head 330 is coupled with the mouth 312 (e.g., indirectly coupled via the adapter 324) of the container 310. The liquid passage 333 extends through the dispense head 330 and the diptube 335 in order to permit liquid-containing material to be withdrawn from a lower (e.g., bottom) portion of the liner 320.

As shown in FIGS. 3A-3B, the valves 342, 343, 344 are arranged in or on the dispense head 330 and are further arranged so as not to extend beyond the width of the upper rim 311 of the container 310. The container 310, liner 320, and dispense head 330 may be used to perform liquid handling methods as disclosed herein.

Referring to FIGS. 4-6, 7, 9, 10 and 20, a container 410 in accord with embodiments of the invention is illustrated. The container generally comprises a container portion 412, an upper chime 414, and a lower chime 416. The container portion has a cylindrical wall portion 418, an upper endwall 420, and a lower endwall 422, each of the upper and lower endwalls may be dome shaped. The upper endwall has a threaded mouth 440 extending therefrom providing access to the interior 442 of the container and container portion. The upper chime defines a protective region 444.

Engaged with the container in the protective region is a dispense head 450; engaged with the dispense head and mouth of the container is a liner 456 configured as a bag 457 with a fitment 458. The bag is sized and configured to form fit the interior of the container. The fitment cooperates with a fitment retainer 464 which has two halves 465 to clamp around the fitment and seat in the mouth 440 of the container.

The upper chime extends a distance vertically from the container portion beyond the uppermost portion 468 of the dispense head thus providing protection for the dispense head and the connection of lines thereto. In embodiments the chime extends upward a distance D1 from the container portion at least 20% of the length L1 of the cylindrical wall portion of the container portion. In embodiment at least 25%, in embodiments, at least 30%. In embodiments the distance D4 from the uppermost surface 472 of the upper endwall is at least 15% of the entire height H1 of the container, in other embodiments, at least 20%, in other embodiments, at least 25%.

A cover 470 engages a lip 480 of the upper chime and seats on the uppermost portion of the lip 482. An engagement member 486, such as a spring member, may be used to secure the plate to the chime, In other embodiments, the plate may be hinged to the container or tethered thereto.

Referring to FIGS. 7, 8, 10-19, details of dispense heads incorporating inventive aspects are illustrated. The dispense head 450 comprises generally a probe portion 500, a lower body portion, 506, and upper body portion 508, and a nut 510. The probe portion 500 has male fitting configured as a nipple 520 that is received in an end of the diptube 524. The nipple has a fluid passageway 528 that is the fluid fill and dispense conduit. Two additional fluid passageways 532, 534 provide venting or gas access to the headspace 538 above the liquid in the bag 457 and have lower outlets 535, 536 next to and proximate the nipple 520. Additionally two fluid passageways 544, 546, extend through the upper body and lower body and through o-rings 550 that seal the passageway at the juncture 552 of the upper body and lower body.

The probe portion 500 has a radially extending flange portion 560 that is sandwiched, radially and axially captured, between the upper body portion and the lower body portion at a recess 562. The nut is also constrained and axially and radially captured at a recess 564 in the bottom facing surface 565 of the upper body portion. The upper body portion 508 and lower body portion 506 are secured together by screws 569. A bushing 574 is sandwiched between the upper body portion and the nut providing a cushioning or quieting effect on the nut rotation. An o-ring 578 seats in groove 580 of the lower body portion for sealing with the upper surface 582 or the mouth of the container. The groove extends radially inward and upward at about a 45 degree angle 585 from horizontal to provide radial and axial compression during scaling. In embodiments at an angle from horizontal of 30 to 60 degrees.

Figure 19:
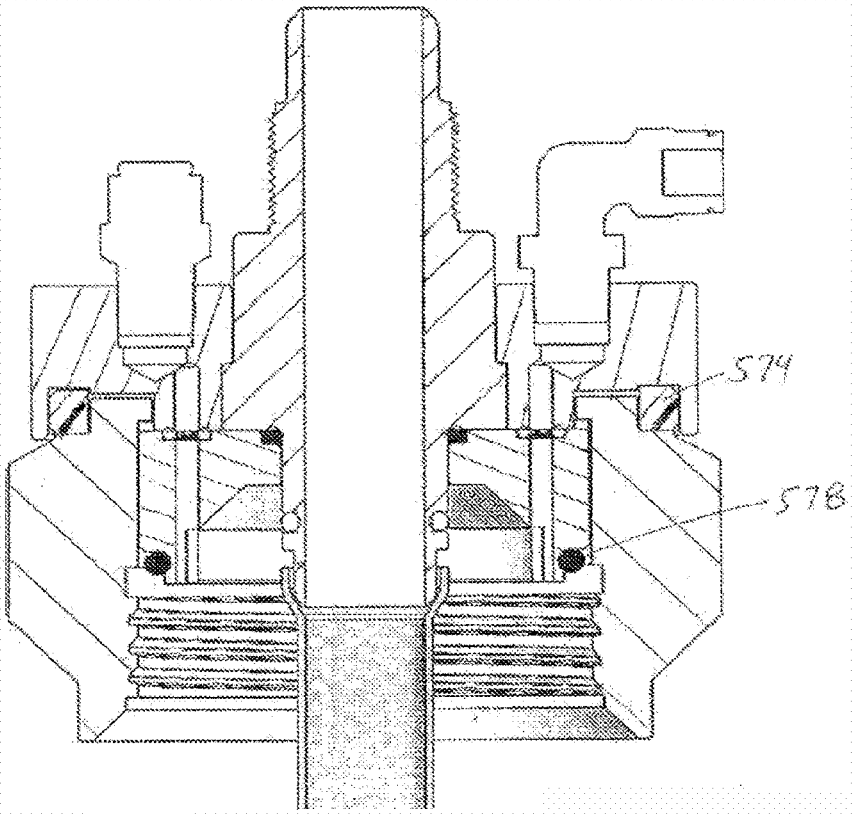
FIG. 19 is a cross sectional view of another dispense head according to embodiments of the invention.
Figure 21:
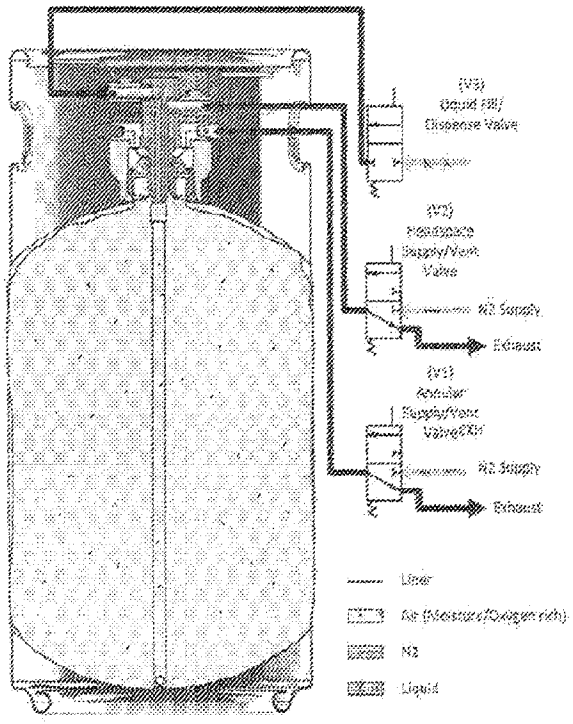
FIG. 21 is a cross-sectional schematic view of a Step 2 of a process and utilizing apparatus in accord with embodiments of the invention. The drawing represents the actions of connecting the connectors of the dispense head to the fill system. Specifically, attach liner, collapse/inflate line, Headspace vent/inflate line, and liquid fill/dispense line to connector.
Figure 20:
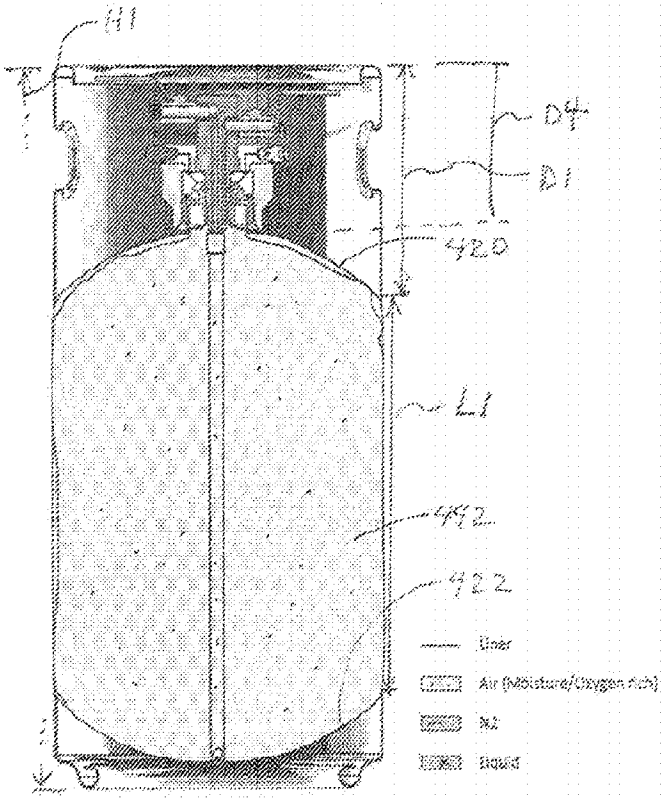
FIG. 20 is a cross-sectional schematic view of a Step 1 of a process and utilizing apparatus in accord with embodiments of the invention. The drawing represents the actions of inserting the liner configured as a bag into the container, attaching the dispense head and diptube and inflating the bag.
Figure 22:
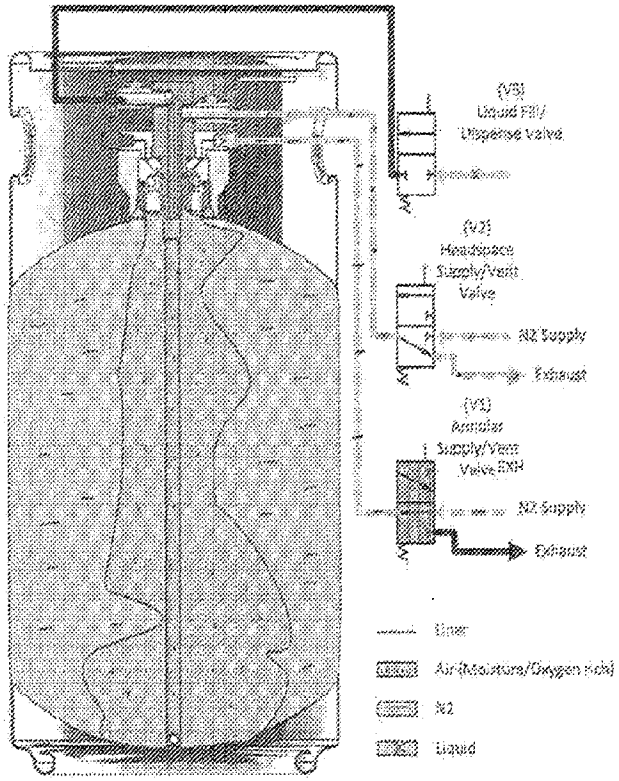
FIG. 22 is a cross-sectional schematic view of a Step 3 of a process and utilizing apparatus in accord with embodiments of the invention. The drawing represents the actions of collapsing the liner by the open headspace valve, and an open annular supply/vent valve to supply gas to collapse liner.
Figure 23:
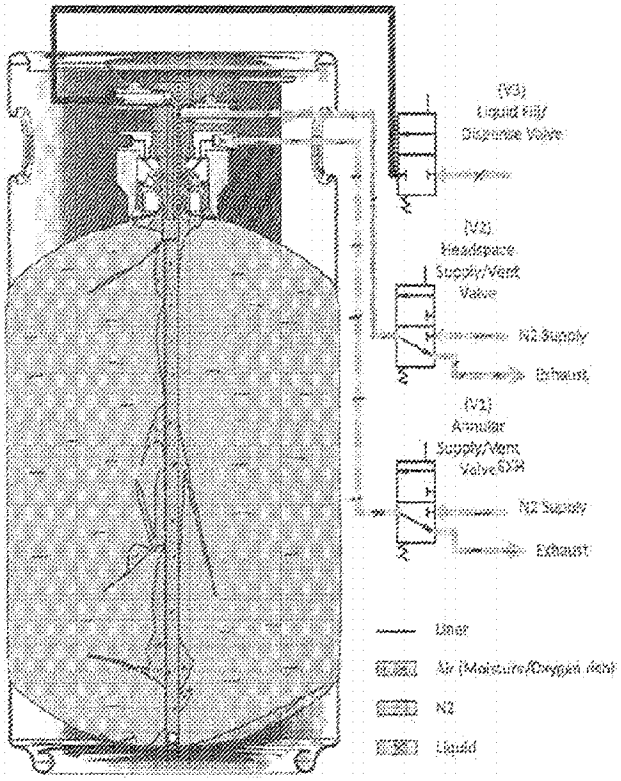
FIG. 23 is a cross-sectional schematic view of a Step 4 of a process and utilizing apparatus in accord with embodiments of the invention. The drawing represents the actions of collapsing the liner which forces the air in the bag out of the bag by opening headspace valve and open annular supply valve.
Figure 25:
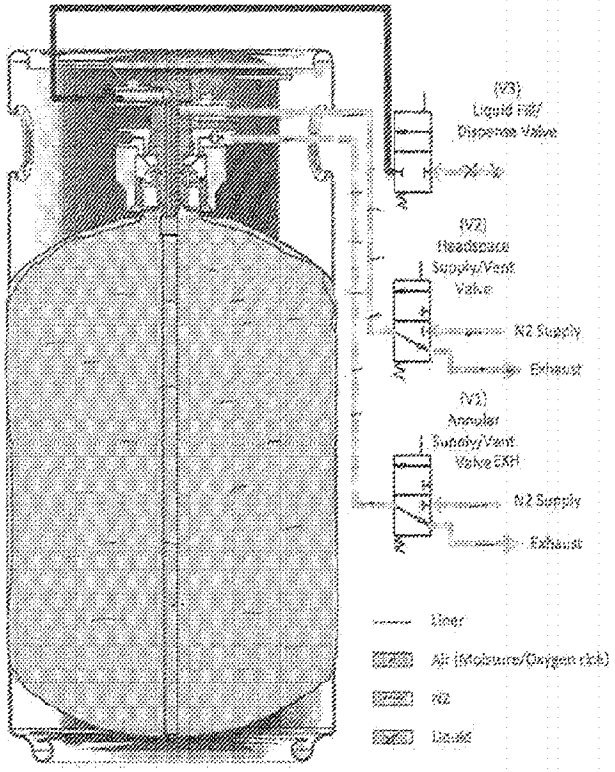
FIG. 25 is a cross-sectional schematic view of a Step 6 of a process and utilizing apparatus in accord with embodiments of the invention. The drawing represents the actions of inflating the liner by leaving the headspace valve open and closing the headspace supply gas to vent pressure. The Step includes repeating as appropriate or desired the deflating and inflating.
Figure 24:
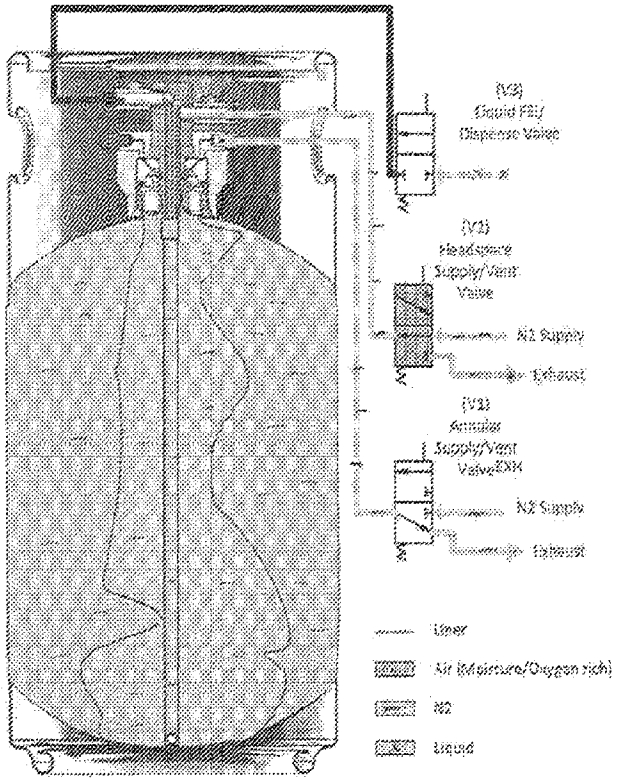
FIG. 24 is a cross-sectional schematic view of a Step 5 of a process and utilizing apparatus in accord with embodiments of the invention. The drawing represents the actions of inflating the liner with headspace ball open to Nitrogen supply.
Figure 27:
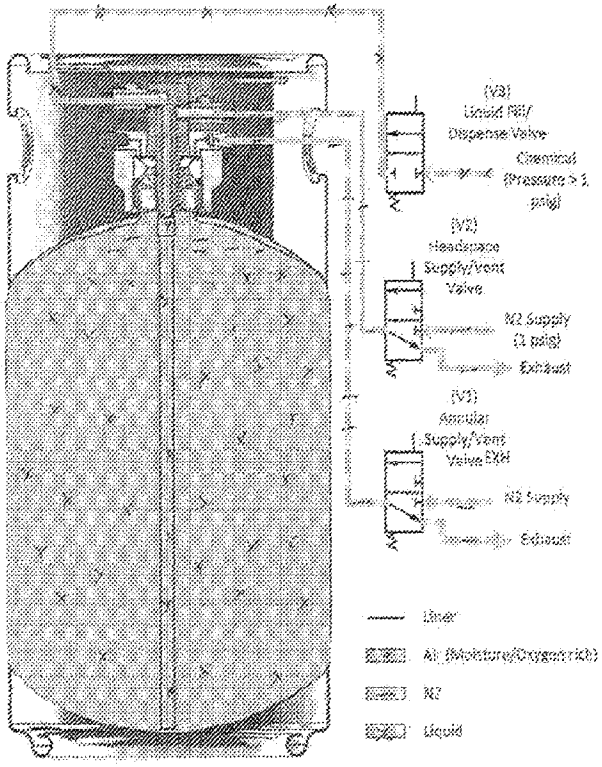
FIG. 27 is a cross-sectional schematic view of a Step 8 of a process and utilizing apparatus in accord with embodiments of the invention. The drawing represents the actions of a filled container and closing the liquid fill/dispense valve, close headspace valve to Nitrogen supply and close annular supply and vent, plug annular space connector.
Figure 26:
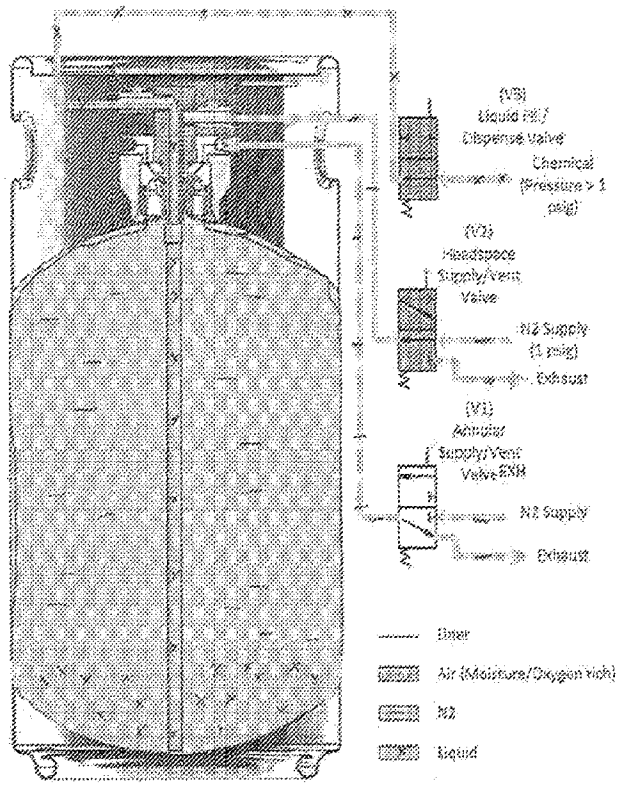
FIG. 26 is a cross-sectional schematic view of a Step 7 of a process and utilizing apparatus in accord with embodiments of the invention. The drawing represents the actions filling the liner with the chemical liquid with the headspace valve open, the liquid fill/dispense valve open, option to either open headspace supply valve to supply low pressure nitrogen to headspace or leave open to vent to allow for gas escape during fill.
Figure 29:
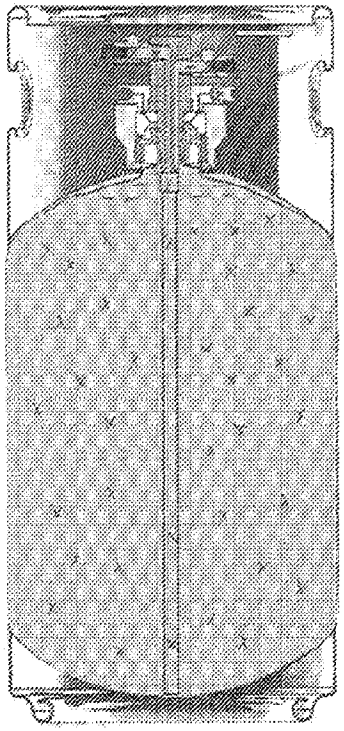
FIG. 29 is a cross-sectional schematic view of a Step 10 of a process and utilizing apparatus in accord with embodiments of the invention. The drawing represents the actions of transporting the container with dispense head and liquid contents to an end user or storage.
Figure 28:
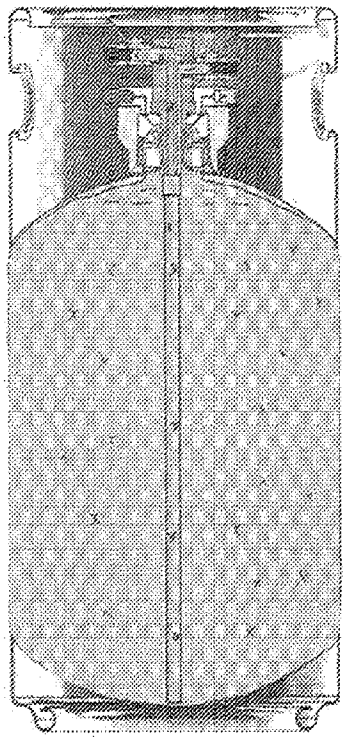
FIG. 28 is a cross-sectional schematic view of a Step 9 of a process and utilizing apparatus in accord with embodiments of the invention. The drawing represents the actions of removing all connections and confirm valves closed. The container with liquid is ready for shipping. The cover may be added to close the opening defined by the upper chime.
Figure 31:
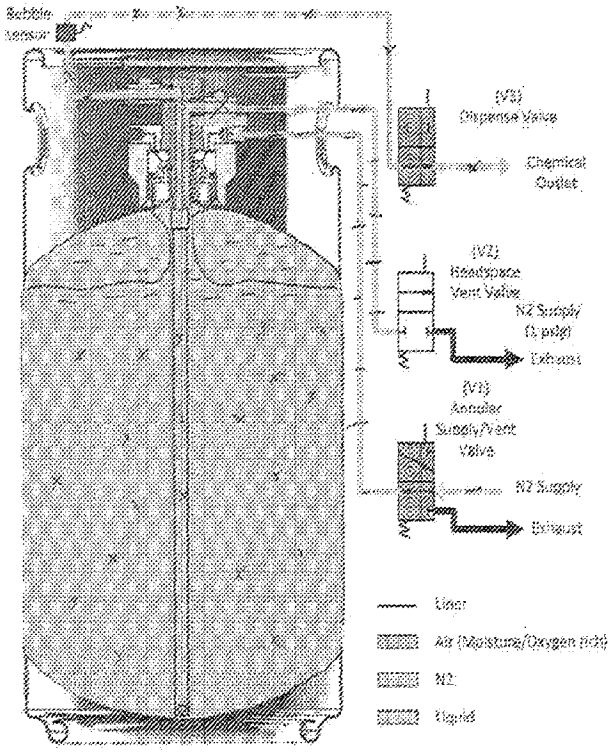
FIG. 31 is a cross-sectional schematic view of a Step 12 of a process and utilizing apparatus in accord with embodiments of the invention. The drawing represents the actions of chemical liquid delivery with the dispense valve open, opening the annular supply/vent valve to pressurize container, remove headspace gas until liquid is sensed.
Figure 30:
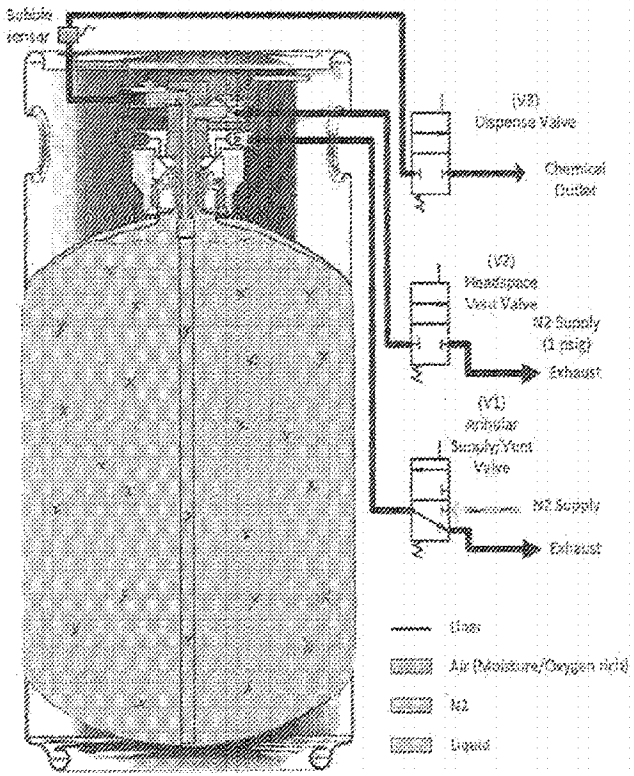
FIG. 30 is a cross-sectional schematic view of a Step 11 of a process and utilizing apparatus in accord with embodiments of the invention. The drawing represents the actions of connecting the dispense head to a delivery system, opening the headspace delivery valve.
Figure 33:
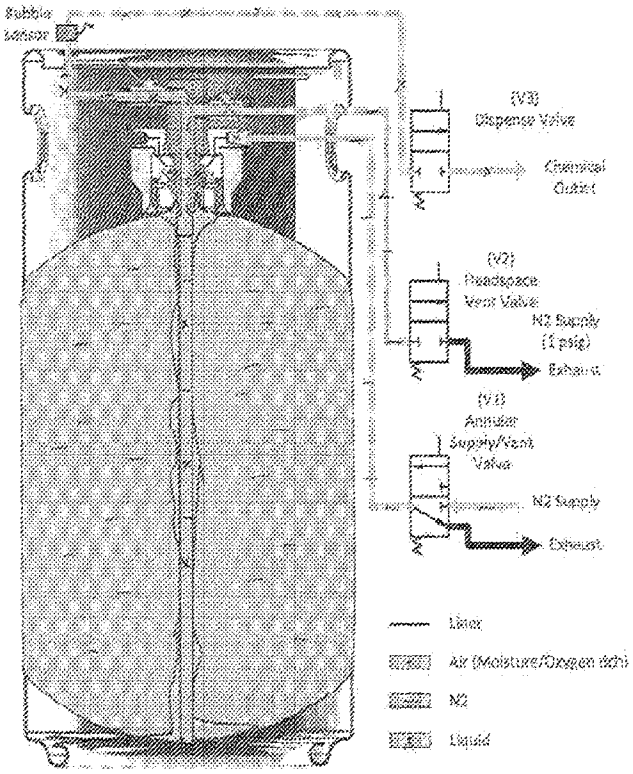
FIG. 33 is a cross-sectional schematic view of a Step 14 of a process and utilizing apparatus in accord with embodiments of the invention. The drawing represents the package being empty where then the dispense valve is closed and the annular supply/vent valve is closed to nitrogen and open to exhaust.
Figure 32:
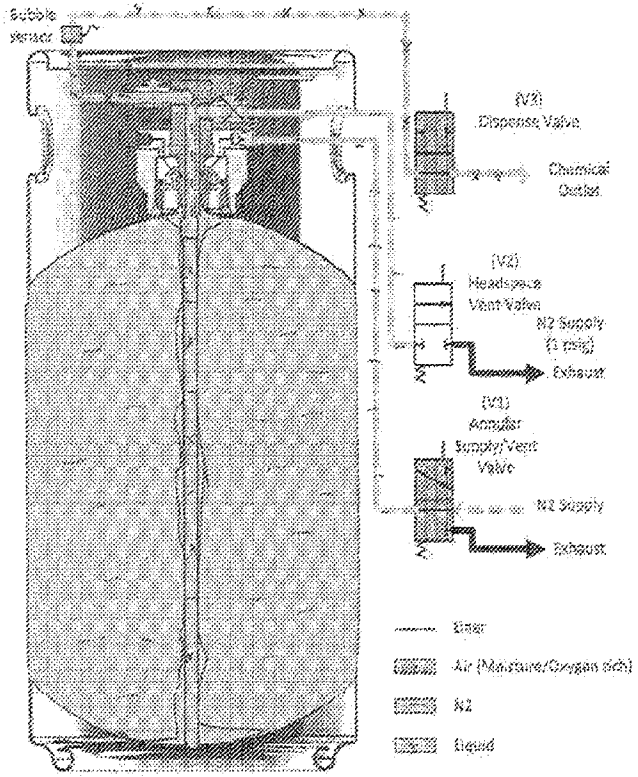
FIG. 32 is a cross-sectional schematic view of a Step 13 of a process and utilizing apparatus in accord with embodiments of the invention. The drawing represents dispensing the chemical liquid until empty.
Figure 35:
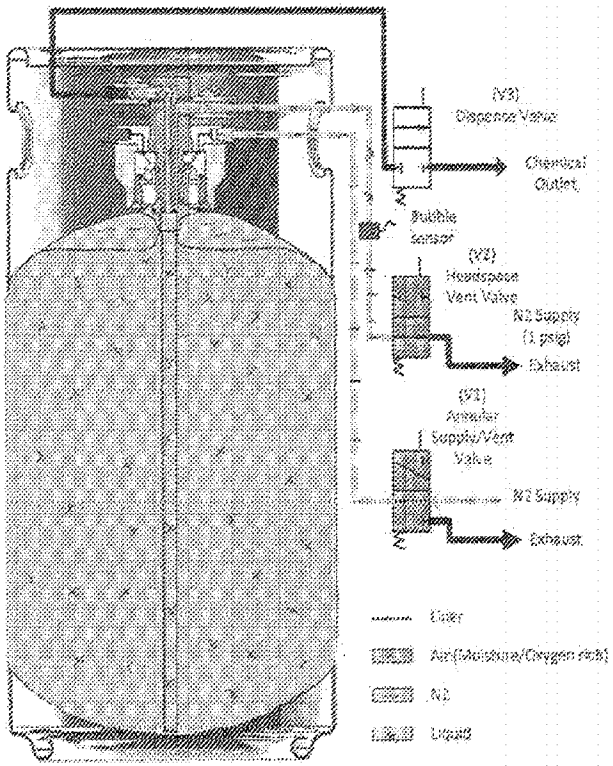
FIG. 35 is a cross-sectional schematic view of an alternate Step 12 of a process and utilizing apparatus in accord with embodiments of the invention where zero headspace is desired. The actions consisting of having the headspace removal valve open, opening the annular supply/vent valve connected to nitrogen to pressurize the container and continuing headspace removal until gas gone.
Figure 34:
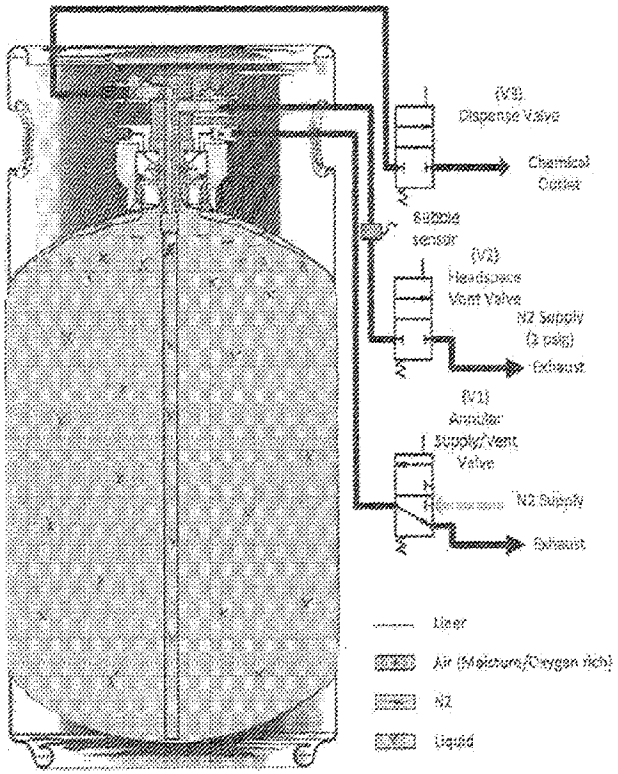
FIG. 34 is a cross-sectional schematic view of an alternate Step 11 of a process and utilizing apparatus in accord with embodiments of the invention where zero headspace is desired. The drawing represents the actions of connecting the dispense head to a delivery system, opening the headspace removal valve.
Figure 37:
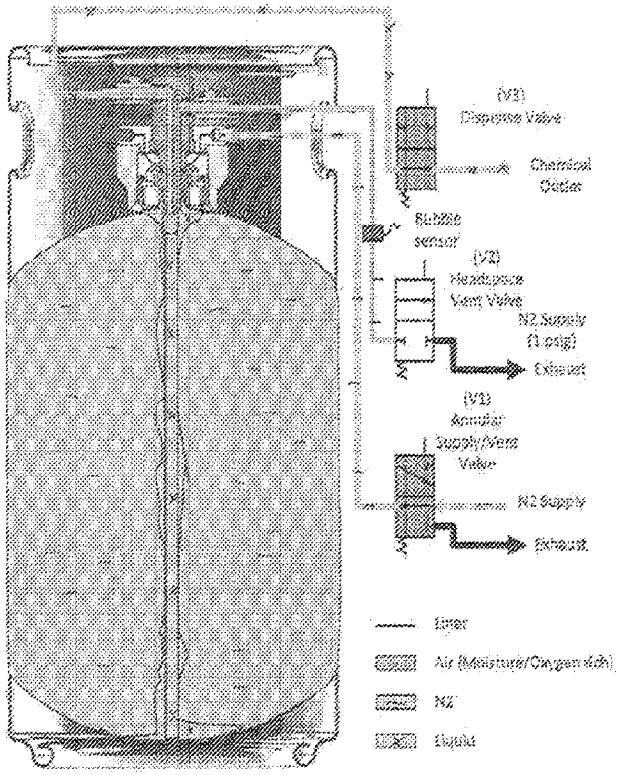
FIG. 37 is a cross-sectional schematic view of a Step 14 of a process and utilizing apparatus in accord with embodiments of the invention. The drawing represents dispensing the chemical liquid until empty.
Figure 36:
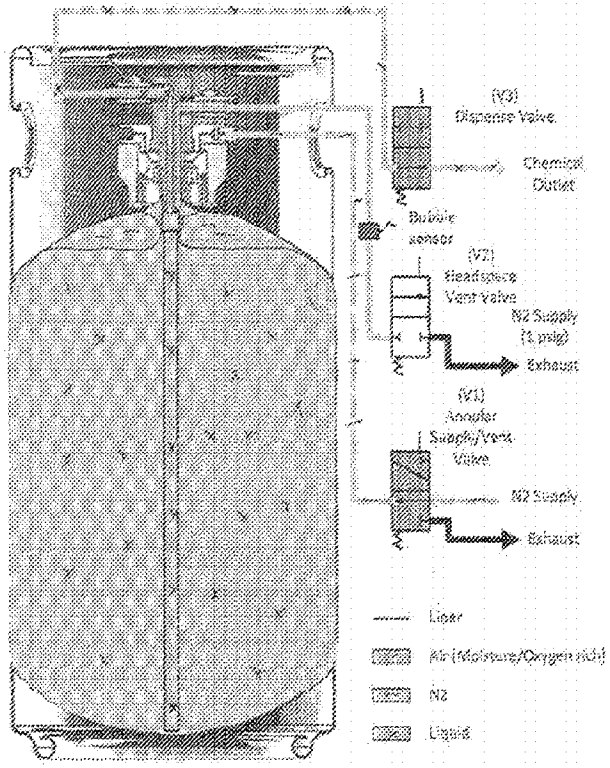
FIG. 36 is a cross-sectional schematic view of a Step 13 of a process and utilizing apparatus in accord with embodiments of the invention. The drawing represents the actions of dispensing the chemical liquid with the closed headspace vent valve, the open chemical delivery valve, and annular supply/vent valve open to the nitrogen supply to pressurize container.
Figure 38:
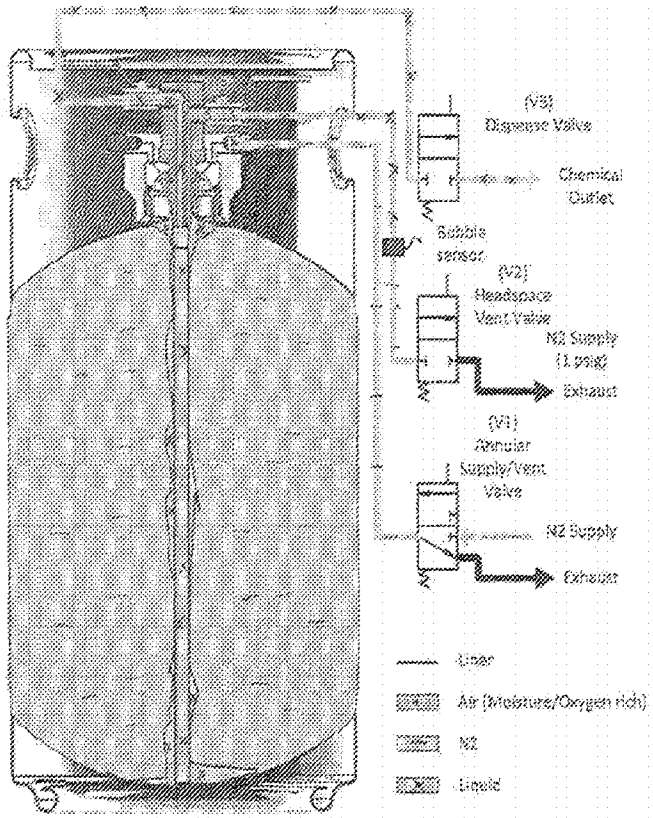
FIG. 38 is a cross-sectional schematic view of a Step 15 of a process and utilizing apparatus in accord with embodiments of the invention. The drawing represents the actions of closing the dispense valve, closing the annular supply/vent valve when the liquid contents have been fully dispensed.

FIG. 19 illustrates a further embodiment of a dispense head with the bushing 574 for cushioning and quieting effect on the nut and o-ring 578 seated in a groove extending at an angle of 30 to 60 degrees from horizontal.

As illustrated in the embodiments of FIGS. 1-3B, valves may be associated with each of the fluid passageways and such valves be part of, coupled to, or associated with the dispense head. The valves may be actuated when connections are made, for example quick connect self sealing fittings, or manually such as ball valves. Bach passageway can have a manual and/or quick connect self sealing connection.

Referring to FIGS. 20 through 38, exemplary steps are set forth to utilize the apparatus described herein such that the environment and personnel are not exposed to the liquid or fumes from the liquids during set-up and dispensing of the liquid in the container at the end use or process facility.

Embodiments disclosed herein may provide one or more of the following beneficial technical effects: reducing ingress of air, moisture, or other contaminants into liner-based pressure containers and apparatuses; reduced spoilage and/or enhancement of shelf life of oxygen-sensitive and/or moisture-sensitive liquid-containing materials; and enablement of connections to be made with liner-based pressure dispense containers including oxygen-sensitive and/or moisture-sensitive liquid-containing materials in air-containing environments (without requiring such connections to be made in a vacuum environment, an inert gas environment, or other controlled environment).

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Any one or more features described in connection with one or more embodiment(s) are contemplated to combined with one or more features of any other embodiment(s), unless specifically indicated to the contrary herein. Correspondingly, the invention as hereinafter claimed is intended to be broadly construed and interpreted, as including all such variations, modifications and alternative embodiments, within its spirit and scope.

The invention claimed is:

1. A dispense head for coupling with the mouth of a rigid container and with a bag in the container for holding a liquid to be dispensed, the dispense head comprising: a central probe portion axially extending a vertical length of the dispense head and having a first fluid passageway and a second fluid passageway, each with respective upper outlets extending horizontally and lower outlets, the probe having a central flange extending radially outward;

an upper body portion with a central aperture radially capturing the central probe portion;

a lower body portion that cooperates with the upper body portion to sandwich the central flange of the central probe portion therebetween;

a nut that extends around the lower body portion and having a inwardly extending flange that is rotatable received in a circular recess between the upper body portion and the lower body portion, the nut having threads to connect with the rigid container.

2. The dispense head of claim 1 wherein a ring is radially positioned outward from the lower body portion of the dispense head and is sandwiched between a downwardly oriented face of the upper body portion and an upperwardly oriented face of the nut, the ring rotatably positioned with respect to the nut and the upper body portion for facilitating rotation of the nut.

3. The dispense head of claim 2 wherein the ring is not exteriorly visible.

4. The dispense head of claim 1 wherein the probe is made of metal and has radially extending fittings integral therewith, and wherein the upper body portion is split into two portions assembleable into a single ring shape body portion that surrounds and engages the probe portion below the integral fittings, allowing the dispense head to be assembled with the integral fittings on the probe.

5. The dispense head of claim 1, wherein an o-ring seal is seated in a groove extending upwardly and radially inward on the lower body portion such that when the dispense head engages the threaded mouth of a container, the o-ring seal is radially and axially compressed between the container mouth and the lower body portion.

6. The dispense head of claim 1, wherein the dispense head has two fluid passageways for fluid communication with an annular space between the liner and a container portion.

7. The dispense head of claim 1, wherein the dispense head has two fluid passageways for fluid communication with an interior of the liner.

8. The dispense head of claim 1, wherein each fluid passageway has a valve associated therewith and connected to the dispense head.

9. The dispense head of claim 1 in combination with the container, the container formed of stainless steel and having an upwardly extending chime that extends upwardly beyond the dispense head.

10. The dispense head in combination with the container of claim 9 wherein the dispense head has a pair of outwardly extending fittings and the upwardly extending chime of the container has apertures in alignment with the pair of outwardly extending fittings.

11. A dispense system comprising:

a container comprising a stainless steel container portion with an outer cylindrical wall, an upper endwall and a lower endwall, each integral with the cylindrical wall, the upper endwall having a mouth for accessing an interior of the container portion, the mouth having threads thereon, and an upper chime extending from the container portion upwardly, the chime including a lip and an uppermost lip portion;

a liner placeable in the interior of the container conforming to said interior, the liner having a fitment for positioning in the mouth of the container;

a dispense head including an upper body portion secured to a lower body portion, a probe portion extending axially through the upper and lower body portion and captured radially and axially within the upper and lower body portions, and a nut sized for engaging with the threaded mouth, wherein the nut is rotatably captured radially and axially between the upper and lower body portions, the dispense head further including a dispense fluid passageway and a gas passageway, the dispense head and upper chime cooperatively sized such that when the dispense head is attached to the mouth of the container the dispense head is entirely below the uppermost lip portion.

12. The dispense system of claim 11 wherein the dispense head has a fitting extending horizontally below the upper most lip portion and the upper chime has an aperture positioned below the uppermost lip portion at a level of and positioned to allow connection of the fitting with a fluid line.

13. The dispense system of claim 11, wherein the container further comprises a circular plate sized to the lip of the upper chime, the plate having a retention member for securing the circular plate to the chime.

14. The dispense system of claim 11 wherein a ring is radially positioned outward from the lower body portion of the dispense head and is sandwiched between a downwardly oriented face of the upper body portion and an upperwardly oriented face of the nut, the ring rotatably positioned with respect to the nut and the upper body portion for facilitating rotation of the nut.

15. The dispense system of claim 11, wherein an o-ring seal is seated in a groove extending upwardly and radially inward on the lower body portion such that when the dispense head engages the threaded mouth of a container, the o-ring seal is radially and axially compressed between the container mouth and the lower body portion.

16. The dispense head of claim 11, wherein the dispense head has two fluid passageways for fluid communication with an annular space between the liner and the container portion and has two fluid passageways for fluid communication with the interior of the liner.

* * * * *